US010358254B2

(12) United States Patent
Buss

(10) Patent No.: US 10,358,254 B2
(45) Date of Patent: Jul. 23, 2019

(54) ZIPPER CARTON ASSEMBLIES FOR BLINDED CLINICAL TRIALS AND METHODS OF ASSEMBLY AND USE

(71) Applicant: FISHER CLINICAL SERVICES, INC., Allentown, PA (US)

(72) Inventor: Michael Buss, Breinigsville, PA (US)

(73) Assignee: Fisher Clinical Services, Inc., Allentown, PA (US)

( * ) Notice: Subject to any disclaimer, the term of this patent is extended or adjusted under 35 U.S.C. 154(b) by 228 days.

(21) Appl. No.: 15/128,386

(22) PCT Filed: Mar. 3, 2016

(86) PCT No.: PCT/US2016/020562
§ 371 (c)(1),
(2) Date: Sep. 22, 2016

(87) PCT Pub. No.: WO2016/144666
PCT Pub. Date: Sep. 15, 2016

(65) Prior Publication Data

US 2018/0170610 A1 Jun. 21, 2018

Related U.S. Application Data

(60) Provisional application No. 62/209,507, filed on Aug. 25, 2015, provisional application No. 62/130,404, filed on Mar. 9, 2015.

(51) Int. Cl.
*B65D 5/50* (2006.01)
*B65D 5/54* (2006.01)
(Continued)

(52) U.S. Cl.
CPC ..... *B65D 5/541* (2013.01); *B65D 5/3621* (2013.01); *B65D 5/5021* (2013.01); *B65D 5/522* (2013.01);
(Continued)

(58) Field of Classification Search
CPC ..... B65D 2571/00567; B65D 2571/00907; B65D 5/541; B65D 5/50; B65D 5/5002; B65D 5/5007
(Continued)

(56) References Cited

U.S. PATENT DOCUMENTS 2,284,283 A * 5/1942 Himes ..... B65D 5/3621 229/117
4,174,041 A 11/1979 Turner
(Continued)

FOREIGN PATENT DOCUMENTS

DE 75 08 653 U 9/1976
DE 20 2012 003954 U1 7/2013
(Continued)

OTHER PUBLICATIONS

International Search Report and Written Opinion dated Jul. 20, 2016, issued in PCT Application No. PCT/US2016/020562, filed Mar. 3, 2016.
(Continued)

*Primary Examiner* — Justin M Larson
(74) *Attorney, Agent, or Firm* — Workman Nydegger

(57) ABSTRACT

A zipper carton assembly for receiving a blinded trial product includes a carton body having an encircling side wall, a floor, and a covering that together bound an inner compartment for receiving the blinded trial product, an adhesive layer disposed on a portion of the covering, and a removable liner covering at least a portion of adhesive layer. The covering includes an inner closure panel that folds into a closed position to selectively cover an access opening to the inner compartment and an opposing outer closure panel that folds over and is secured to a portion of the inner closure panel by means of the adhesive layer. The removable liner covers the adhesive layer until the zipper carton assembly is
(Continued)

ready for sealing. The sealed zipper carton assembly can be opened by removing a zipper tear strip formed in a portion of the covering.

26 Claims, 17 Drawing Sheets

(51) Int. Cl.
*B65D 5/66* (2006.01)
*B65D 5/36* (2006.01)
*B65D 5/52* (2006.01)

(52) U.S. Cl.
CPC ..... *B65D 5/5455* (2013.01); *B65D 5/6608* (2013.01); *B65D 5/6661* (2013.01); *B65D 5/6664* (2013.01); *B65D 5/50* (2013.01); *B65D 5/5002* (2013.01); *B65D 5/5007* (2013.01)

(58) Field of Classification Search
USPC ..... 229/117, 206, 240, 241
See application file for complete search history.

(56) References Cited

U.S. PATENT DOCUMENTS 4,266,716 A * 5/1981 Austin ..... B65D 5/3621 229/116
4,653,639 A * 3/1987 Traynor ..... B65D 85/546 206/308.3
5,318,222 A * 6/1994 Bartlett ..... B42F 7/02 206/308.3
5,833,057 A * 11/1998 Char ..... B01L 9/06 206/204
6,409,077 B1 * 6/2002 Telesca ..... B65D 5/5007 206/45.29
7,080,736 B2 * 7/2006 Jackson ..... B65D 5/16 206/738
7,392,904 B1 * 7/2008 Jackson ..... B65D 25/24 206/423
7,841,511 B2 * 11/2010 Fogle ..... B65D 5/10 229/117
8,025,209 B2 * 9/2011 Garner ..... B65D 5/18 229/120.09
10,035,617 B1 * 7/2018 Shipp ..... B65B 57/18
2005/0145683 A1 * 7/2005 Alagna ..... B65D 5/541 229/102
2006/0081690 A1 * 4/2006 Bates ..... B65D 5/0005 229/101
2014/0102934 A1 * 4/2014 Gatto ..... B65D 77/042 206/459.5
2016/0137335 A1 * 5/2016 Mora ..... B65D 5/0227 53/412
2018/0105313 A1 * 4/2018 Buss ..... B65D 5/0236
2018/0170610 A1 * 6/2018 Buss ..... B65D 5/6661
2018/0215499 A1 * 8/2018 Imai ..... B65D 5/5004

FOREIGN PATENT DOCUMENTS

EP 1 481 922 A1 12/2004
GB 2 315 239 A 1/1998

OTHER PUBLICATIONS

*Handbook of Folding Carton Style Nomenclature*, Paperboard Packaging council, 1992, 4 pages.
*Fibre Box Handbook*, Fibre Box Association, 1999, 4 pages.

* cited by examiner

ZIPPER CARTON ASSEMBLIES FOR BLINDED CLINICAL TRIALS AND METHODS OF ASSEMBLY AND USE

BACKGROUND

1. Technical Field

The present disclosure relates to cartons designed for use in blinded clinical trials, and, more specifically, to sealable, single use zipper cartons adapted for assembling blinded clinical test kits, and to related methods of assembly and use.

2. Relevant Technology

Clinical trials for many pharmaceutical drugs require that a drug and a placebo be delivered and administered in a blinded study. As part of the blinded clinical trial protocols, the drug and placebo are placed in separate unmarked containers. Accordingly, the administering technician and recipient are blind as to the identity of the product, the concentration thereof, or other characteristic being studied that may otherwise be reported on the retail label of the drug container.

To facilitate transport and delivery of the drug/placebo, the unmarked containers can be sealed in a box. For instance, an unmarked dosage vial or tube can be placed in a box having a lid that can be folded over to close the box. Once the lid is closed, a sealing sticker is manually placed on the outside of the box so as to extend between the lid and the body of the box, thereby fixing the lid closed and sealing the contents therein. The unbroken sealing sticker indicates that the box has not been opened following sealing of the product therein. The box can also be marked with a label that includes an identification number or other information associated with the included product. However, this identifying information is keyed to a reference list and is only useful in identifying the product in combination with that list. Accordingly, the box may also lack any direct, product-identifying marks or labels to ensure fidelity of the blinded study.

One of the difficulties in conducting blinded trials is ensuring that there is no indirect identifying and/or associating information that can inadvertently convey to the participants information about the drug/placebo they are taking. For instance, variation between the placement (e.g., location, orientation, etc.) of the sealing stickers on the boxes can provide an indication of product identity. Specifically, differences in the placement of sealing stickers between adjacent boxes or between current and former boxes may cause a participant to infer that the products between the two boxes are different or that one box is more likely to have an active drug as opposed to a placebo. Such perceived differences can defeat the objective of the blinded trials. Because even slight differences between the human-applied sealing stickers on two separate boxes can lead the technician or recipient to believe that the containers disposed therein contain different products, controlling such perceived differences can be vital to the efficacy and fidelity of the clinical trial.

Accordingly, what is needed in the art are blinded trial boxes and assemblies that overcome all or some of the above shortcomings.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
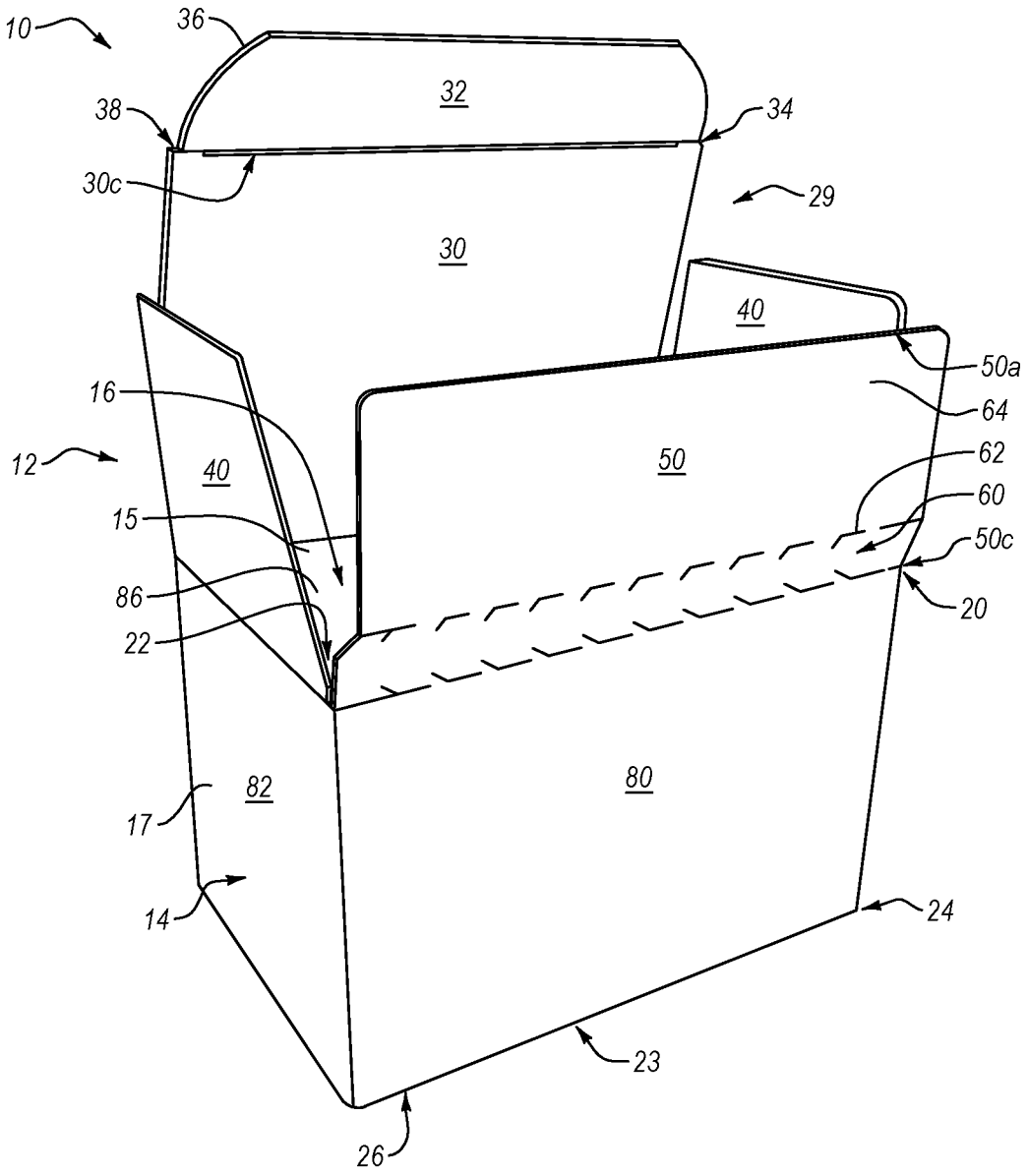
FIG. 1 is a front perspective view of a zipper carton assembly in an erected and opened configuration incorporating features of the present disclosure.

Before describing the present disclosure in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular embodiments of the present disclosure, and is not necessarily intended to limit the scope of the disclosure in any particular manner. Thus, while the present disclosure will be described in detail with reference to specific embodiments, features, aspects, configurations, etc., the descriptions are illustrative and are not to be construed as limiting the scope of the claimed invention. Various modifications can be made to the illustrated embodiments, features, aspects, configurations, etc. without departing from the spirit and scope of the invention as defined by the claims. Thus, while various aspects and embodiments have been disclosed herein, other aspects and embodiments are contemplated.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only certain exemplary materials and methods are described herein.

Various aspects of the present disclosure, including devices, systems, methods, etc., may be illustrated with reference to one or more exemplary embodiments or implementations. As used herein, the terms "alternative embodiment" and/or "exemplary implementation" means "serving as an example, instance, or illustration," and should not necessarily be construed as preferred or advantageous over other embodiments or implementations disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the content clearly dictates otherwise. Thus, for example, reference to a "panel" includes one, two, or more panels. Similarly, reference to a plurality of referents should be interpreted as comprising a single referent and/or a plurality of referents unless the content and/or context clearly dictate otherwise. Thus, reference to "panels" does not necessarily require a plurality of such panels. Instead, it will be appreciated that independent of conjugation; one or more panels are contemplated herein.

As used throughout this application the words "can" and "may" are used in a permissive sense (i.e., meaning having the potential to), rather than the mandatory sense (i.e., meaning must). Additionally, the terms "including," "having," "involving," "containing," "characterized by," variants thereof (e.g., "includes," "has," and "involves," "contains," etc.), and similar terms as used herein, including the claims, shall be inclusive and/or open-ended, shall have the same meaning as the word "comprising" and variants thereof (e.g., "comprise" and "comprises"), and do not exclude additional, un-recited elements or method steps, illustratively.

Various aspects of the present disclosure can be illustrated by describing components that are coupled, attached, connected, and/or joined together. As used herein, the terms "coupled", "attached", "connected," and/or "joined" are used to indicate either a direct connection between two components or, where appropriate, an indirect connection to one another through intervening or intermediate components. In contrast, when a component is referred to as being "directly coupled", "directly attached", "directly connected," and/or "directly joined" to another component, no intervening elements are present or contemplated. Thus, as used herein, the terms "connection," "connected," and the like do not necessarily imply direct contact between the two or more elements. In addition, components that are coupled, attached, connected, and/or joined together are not necessarily (reversibly or permanently) secured to one another. For instance, coupling, attaching, connecting, and/or joining can comprise placing, positioning, and/or disposing the components together or otherwise adjacent in some implementations.

As used herein, directional and/or arbitrary terms, such as "top," "bottom," "front," "back," "left," "right," "up," "down," "upper," "lower," "inner," "outer," "internal," "external," "interior," "exterior," "proximal," "distal" and the like can be used solely to indicate relative directions and/or orientations and may not otherwise be intended to limit the scope of the disclosure, including the specification, invention, and/or claims.

Where possible, like numbering of elements have been used in various figures. In addition, similar elements and/or elements having similar functions may be designated by similar numbering (e.g., element "10" and element "210.") Furthermore, alternative configurations of a particular element may each include separate letters appended to the element number. Accordingly, an appended letter can be used to designate an alternative design, structure, function, implementation, and/or embodiment of an element or feature without an appended letter. Similarly, multiple instances of an element and or sub-elements of a parent element may each include separate letters appended to the element number. In each case, the element label may be used without an appended letter to generally refer to instances of the element or any one of the alternative elements. Element labels including an appended letter can be used to refer to a specific instance of the element or to distinguish or draw attention to multiple uses of the element. However, element labels including an appended letter are not meant to be limited to the specific and/or particular embodiment(s) in which they are illustrated. In other words, reference to a specific feature in relation to one embodiment should not be construed as being limited to applications only within said embodiment.

It will also be appreciated that where a range of values (e.g., less than, greater than, at least, and/or up to a certain value, and/or between two recited values) is disclosed or recited, any specific value or range of values falling within the disclosed range of values is likewise disclosed and contemplated herein. Thus, disclosure of an illustrative measurement or distance less than or equal to about 10 units or between 0 and 10 units includes, illustratively, a specific disclosure of: (i) a measurement of 9 units, 5 units, 1 units, or any other value between 0 and 10 units, including 0 units and/or 10 units; and/or (ii) a measurement between 9 units and 1 units, between 8 units and 2 units, between 6 units and 4 units, and/or any other range of values between 0 and 10 units.

It is also noted that systems, methods, apparatus, devices, products, processes, compositions, and/or kits, etc., according to certain embodiments of the present invention may include, incorporate, or otherwise comprise properties, features, aspects, steps, components, members, and/or elements described in other embodiments disclosed and/or described herein. Thus, reference to a specific feature, aspect, steps, component, member, element, etc. in relation to one embodiment should not be construed as being limited to applications only within said embodiment. In addition, reference to a specific benefit, advantage, problem, solution, method of use, etc. in relation to one embodiment should not be construed as being limited to applications only within said embodiment.

The headings used herein are for organizational purposes only and are not meant to be used to limit the scope of the description or the claims. To facilitate understanding, like reference numerals have been used, where possible, to designate like elements common to the figures.

In general, the present disclosure is directed to zipper carton assemblies that are designed to receive a blinded trial product, and to methods of using the same. The zipper carton assembly includes a carton body, which can have a box shaped configuration having an inner compartment for receiving the blinded trial product. An adhesive layer, such as in the form of an adhesive strip, is disposed on a lid of the carton body for sealing the lid closed. The adhesive layer is disposed on an interior surface of the lid so that it is not visible when the lid is sealed closed. A removable liner covers at least a portion of the adhesive layer so that the carton body can be manipulated and prepared to receive the product without inadvertently engaging the adhesive layer. In addition, the carton body can be configured with a removable zipper tear strip to open the carton body after the lid is sealed closed so as to commence the blinded trial. The carton body can also be formed with an automatic folding floor that flattens into position upon erection of the carton body.

Accordingly, embodiments of the zipper carton assembly described herein can comprise a pre-assembled and/or erectable, disposable, sealable, single use box adapted for assembling a blinded clinical trial kit. The zipper carton assembly can be configured to receive one or more blinded trial products therein and can be erectable and sealable without the application of any additional adhesive or sealing agent. For instance, the zipper carton assembly can be sealed in a secure manner without the use of external and/or additional sealing tape or stickers. Such sealing tape or stickers are typically undesirable because they can distinguish a carton assembly that includes an active trial product from a carton assembly that includes a placebo trial product and thus influence a blinded trial.

Various embodiments of the zipper carton assembly described herein can include a removable liner that covers the adhesive sealing layer, allowing the zipper carton assembly and/or zipper carton assembly template to be manufactured, formed, etc. at a first time and (thereafter) assembled, erected, and/or sealed at a second time. In addition, certain embodiments of the zipper carton assembly described herein can be assembled, erected, formed, manipulated, etc. without the use of any adhesive material. For instance, some embodiments can include zipper carton assembly templates that can be assembled, erected, formed, manipulated, etc. into a self-supporting zipper carton assembly without gluing a first portion of the zipper carton assembly template to a second portion of the zipper carton assembly template. It will be appreciated that such embodiments can still include an adhesive layer for sealing the zipper carton assembly upon being assembled, erected, formed, manipulated, etc. without negating the above-recited benefit and/or otherwise departing from the present disclosure.

Thus, embodiments of the present disclosure provide a variety of advantages above and/or over know containers and/or provide unique solutions to problems in the art not otherwise addressed by existing containers. Various embodiments will now be discussed in further detail with reference being made to the Figures of the present disclosure.

Zipper Carton Assembly

Figure 2:
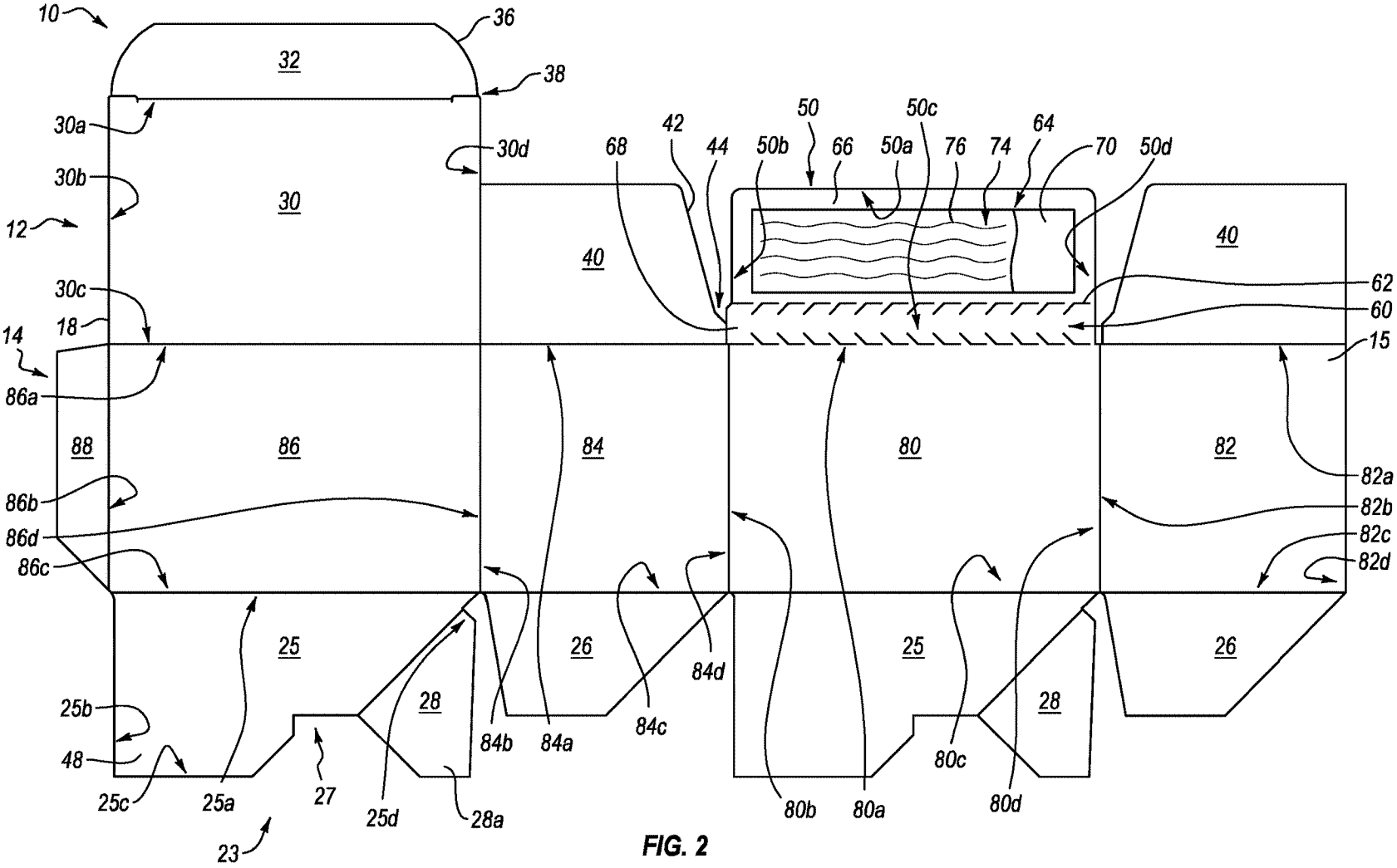
FIG. 2 is a top plan view of the zipper carton assembly shown in FIG. 1 in a flat, disassembled condition.

Depicted in FIGS. 1 and 2 is one embodiment of a zipper carton assembly 10 incorporating features of the present disclosure. Zipper carton assembly 10 generally comprises a carton body 12, an adhesive layer 70, and a removable liner 74 covering at least a portion of adhesive layer 70. Additional details of the various components in accordance with some embodiments of zipper carton assembly 10 will now be described in further detail.

As discussed below in more detail, carton body 12 can be comprised of and/or formed from a foldable sheet of material. For instance, FIG. 2 depicts carton body 12 in a flat disassembled configuration. Specifically, carton body 12 is shown as a template 18 that has been cut, such as through a die press or otherwise formed, so that it can be folded and secured into the box shape configuration as depicted in FIG. 1. Carton body 12 can be comprised of a foldable sheet of material that typically retains a crease when folded. For example, the sheet can comprise a paper-based material, such as paper, cardstock, paperboard or cardboard. In other embodiments, the sheet can be comprised of a synthetic, plastic, or other material (e.g., adapted to retain a crease when folded). The sheet can comprise a single, continuous, unitary structure; a composite; a laminate, an extrusion, or a base sheet having a coating on one or both opposing sides thereof. Template 18 can also be formed of two or more sheets that are connected together, such as through an adhesive or welding. Carton body 12/template 18 can have a thickness suitable for various embodiments of zipper carton assembly 10. For instance, carton body 10 can have a thickness of up to, at least, or about 0.25 mm, 0.5 mm, 1 mm, 1.5 mm, 2 mm, 2.5 mm, 3 mm, and/or 5 mm or between any two of the foregoing. Thicknesses less than 0.25 mm or greater than 5 mm are also contemplated herein. In addition, various components of carton body 10 may have varying or different thicknesses in some embodiments.

With continued reference to FIGS. 1 and 2, carton body 12 of zipper carton assembly 10 generally includes an encircling side wall 14, a floor 23, and a covering 29 that bound an inner compartment 16. Encircling side wall 14 has an inner surface 15 that at least partially bounds compartment 16, an exterior surface 17 opposite inner surface 15, an upper end 20 that bounds an access opening 22 to compartment 16, and an opposing lower end 24 connected to floor 23. Encircling side wall 14 comprises a front panel 80 and an opposing rear panel 86 that both extend between a first side panel 82 and an opposing second side panel 84. Each of panels 80, 82, 84, and 86 have an upper edge 80*a*, 82*a*, 84*a*, and 86*a*, respectively, at upper end 20 of side wall 14 and a lower edge 80*c*, 82*c*, 84*c*, and 86*c*, respectively, at lower end 24 of side wall 14. Panels 80, 82, 84, and 86 also have opposing side edges 80*b* and 80*d*, 82*b* and 82*d*, 84*b* and 84*d*, and 86*b* and 86*d*, respectively.

Encircling side wall 14 can also comprise an attachment flap 88 in some embodiments. As depicted in FIG. 2, for instance, attachment flap 88 can be disposed on (e.g., connected to and/or extending from) first side 86*b* of panel 86. During assembly, attachment flap 88 can be secured to the interior surface of side panel 82, such as by an adhesive or mechanical engagement, so that encircling side wall 14 forms a continuous loop having a substantially rectangular transverse cross section as shown in FIG. 1. It is noted that between each adjacent elements of carton body 12 where one element is designed to be folded relative to the other, such as between adjacent panels or between a panel and an adjacent tab or flap, a crease is formed in the sheet material so as to enable smooth and straight folding between the elements.

Figure 10:
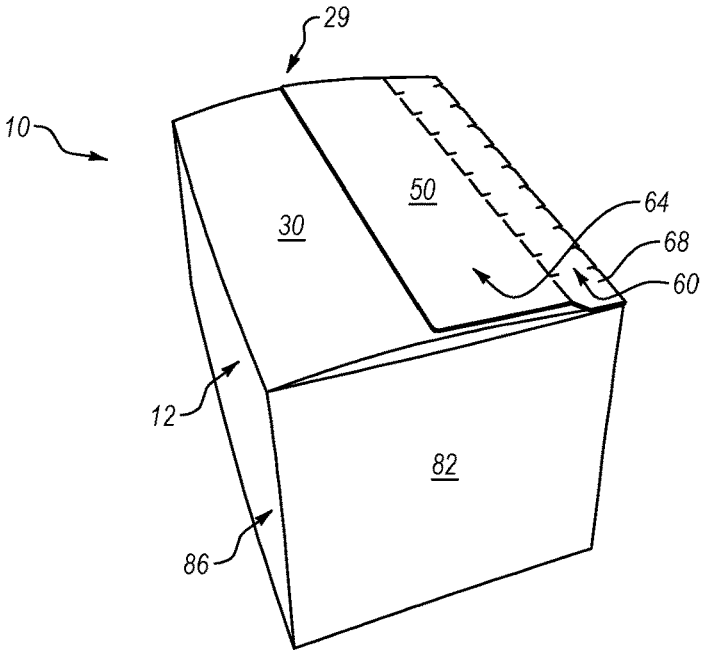
FIG. 10 is a top perspective view of the zipper carton assembly of FIG. 7 in a closed and sealed configuration.

As illustrated in FIG. 10, the final fully assembled and closed carton body 12 can have a box shaped configuration, i.e., a parallelepiped hexahedron, having square or rectangular panels. Accordingly, with reference to FIGS. 1 and 2, panels 80, 82, 84, and 86 can be disposed at successive right angles one to another. In other embodiments, carton body 12 can have other hexahedron or polyhedron configurations or other three dimensional configurations such as cylindrical or conical. As such, encircling side wall 14 can have a circular, oval, or other geometric transverse cross sectional configurations.

Figure 5:
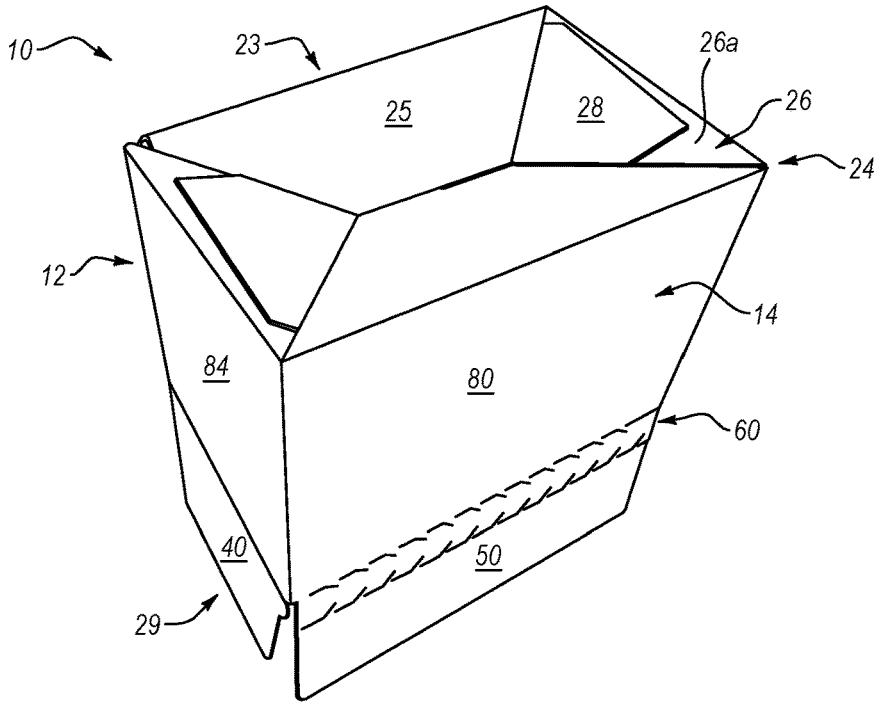
FIG. 5 is a bottom perspective view of the zipper carton assembly of FIG. 1.

As indicated above and depicted in FIG. 5, carton body 12 also includes a floor 23 disposed at lower end 24 of encircling side wall 14. It will be appreciated that floor 23 can have a variety of suitable configurations as known in the art and/or described herein. For instance, floor 23 can comprise one or more floor panels configured to cover bottom end 24 of side wall 14. As depicted in FIG. 2, floor 23 comprises opposing floor panels 25 extending, respectively, from lower edges 80*c* and 86*c* of side wall panels 80 and 86, respectively, and opposing floor panels 26 extending, respectively, from lower edges 82*c* and 84*c* of side wall panels 82 and 84, respectively.

Floor panels 25 are identical to each other and each have an outside edge 25*a* (connected to lower edge 80*c*, 86*c* of side wall panel 80, 86, respectively) and an opposing inside edge 25*c*, each extending between opposing side edges 25*b* and 25*d*. In at least one embodiment, opposing side edges 25*b* and 25*d* can be (substantially) aligned with opposing side edges 80*b* and 80*d*, 86*b* and 86*d*, respectively, of side wall panel 80, 86, respectively (i.e., substantially aligned with the opposing side edges of the side wall panel from which it extends).

It will be appreciated that "substantially" aligned, and similar terms as used herein, refers to an alignment suitable for a zipper carton assembly as described herein. For instance, substantially aligned edges can be either exactly aligned or slightly off-set in alignment.

In one or more embodiments, inside edge 25*c* can comprise a recessed notch 27 and an adjacent outwardly projecting engagement tab 48. Floor panels 25 can also comprise an attachment flap 28 disposed between recessed notch 27 and side edge 25*d*. Attachment flap 28 has an inner surface 28*a* that can be secured to an outer surface 26 (see FIG. 5) of floor panel 26.

Floor panels 26 can also be identical in configuration and can have an outside edge (connected to lower edge 82*c*, 84*c* of side panels 82, 84, respectively) and an opposing inside edge, each extending between opposing side edges. In at least one embodiment, floor panels 26 can have a trapezoidal configuration. Accordingly, the side edge(s) of floor panels 26 can (each) extend at an acute angle from the lower edge of the side wall panel from which the floor panel 26 extends.

Figure 3:
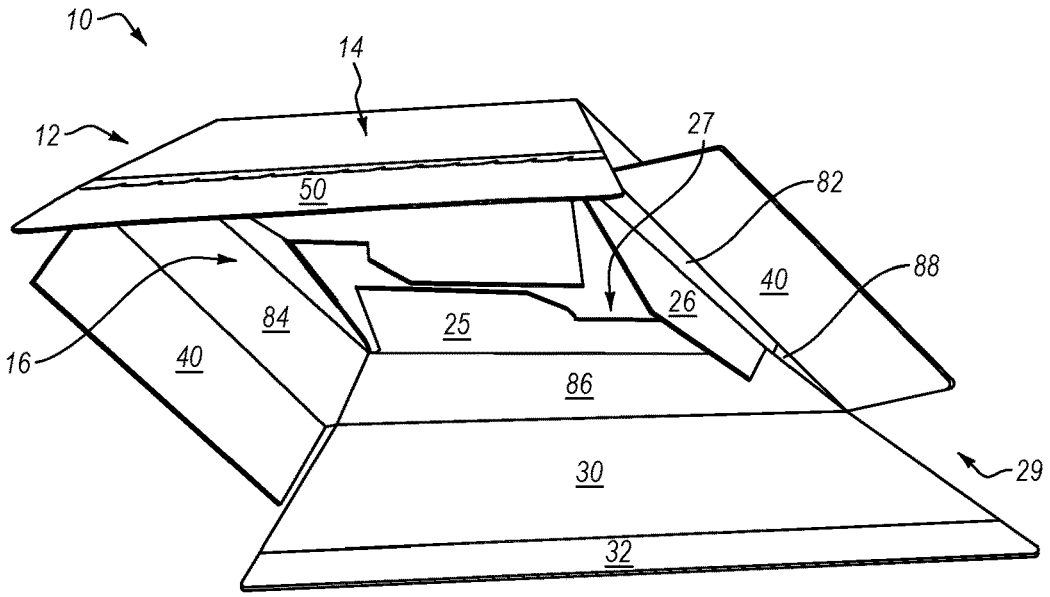
FIG. 3 is a top perspective view of the zipper carton assembly of FIG. 1 in a partially erected configuration.
Figure 4:
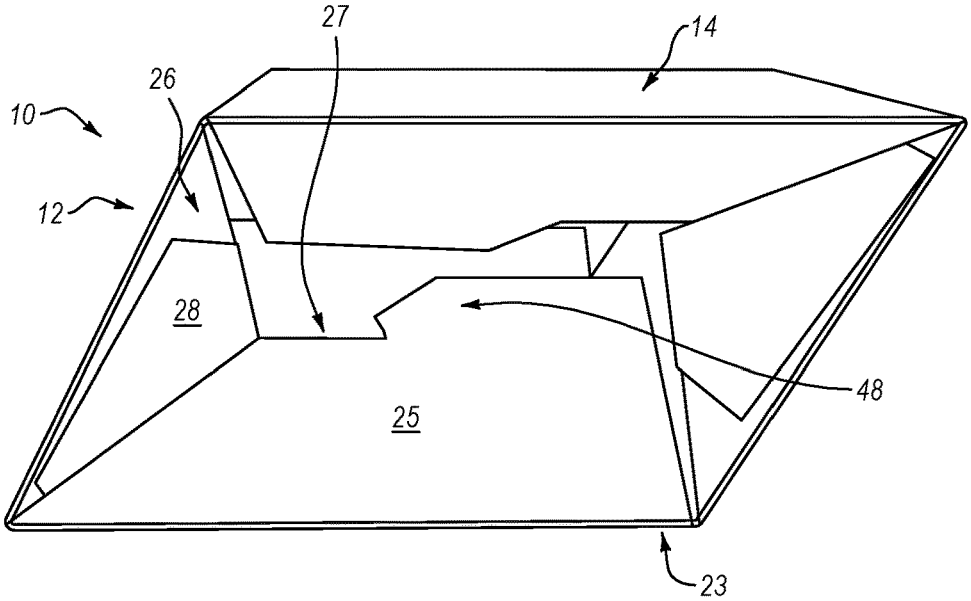
FIG. 4 is a bottom perspective view of the zipper carton assembly of FIG. 3.

Floor panels 25 and 26 are configured to produce an automatic folding floor. Specifically, during assembly of carton body 12, floor 23 can be assembled by attaching floor panel attachment flap 28 of each floor panel 25 to the floor panel 26 (immediately) adjacent to the attachment flap 28, thereby forming opposing sub-floors. In particular, inner surface 28*a* of floor panel attachment flap 28 can be secured to outer surface 26*a* of floor panel 26 (see FIGS. 4 and 5). Attachment flap 88 can be (permanently) bonded to side wall panel 82 and/or floor panel attachment flap 28 can be (permanently) bonded to floor panel 26 by way of an adhesive material (e.g., glue, tape, etc.). The assembled sub-floors are inwardly folded into compartment 16 of carton body 12 as depicted in FIGS. 3 and 4 so that carton body 12 can be folded flat into the collapsed configuration as depicted in FIG. 6.

Figure 6:
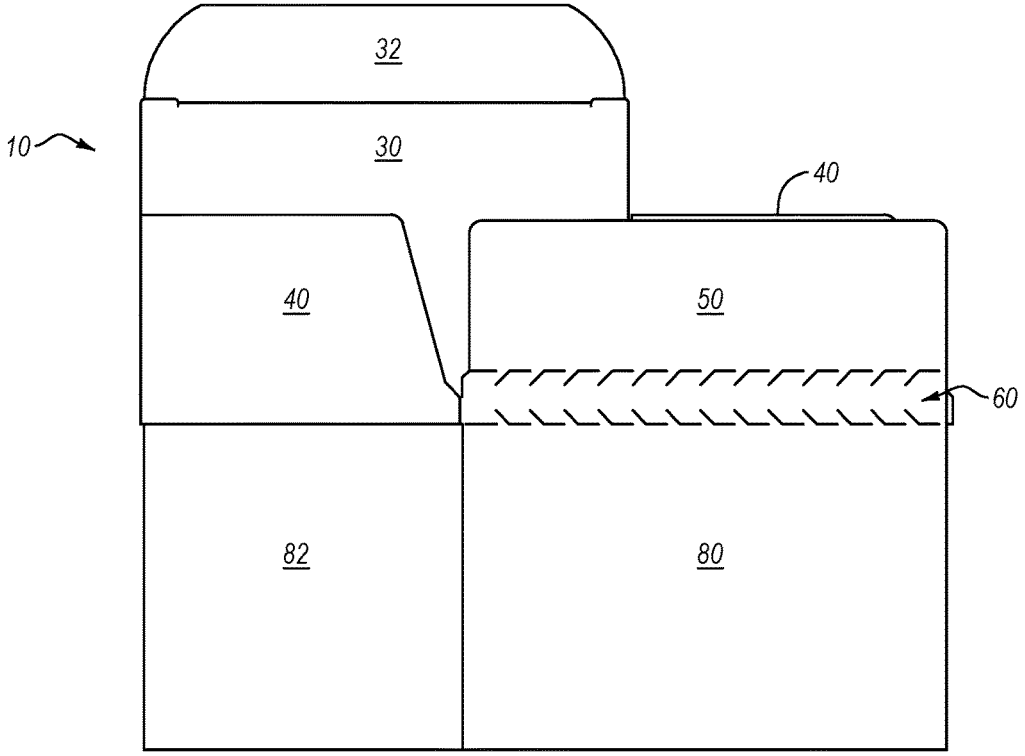
FIG. 6 is a facing view of the zipper carton assembly of FIG. 1 in a collapsed configuration.

During use, carton body 12 is manipulated from the collapsed position shown in FIG. 6 to the erected position as shown in FIGS. 1 and 5. To move to the erected position, encircling side wall 14 is pressed into the box shaped configuration. In so doing, the sub-floors that are folded and collapsed within compartment 16, as depicted in FIGS. 3 and 4, automatically unfold with engagement tabs 48 of floor panels 25 inserting into recessed notches 27 of the opposing floor panels 25 so that engagement tabs 48 interlock and produce the substantially flat floor 23 as depicted in FIG. 5.

Carton body 12 can thus be selectively moved between the collapsed configuration shown in FIG. 6, wherein carton body 12 is substantially flat, and the erected configuration shown in FIGS. 1 and 5, wherein encircling side wall 14 has a substantially rectangular transverse cross section, and vice versa. During the transformation, assembled (automatic folding) floor 23 automatically moves from the collapsed position shown in FIG. 6, through the transition position shown in FIGS. 3 and 4, erected position shown in FIGS. 1 and 5. The process can also be reversed by pressing floor 23 upward into compartment 16 (as illustrated in FIGS. 3 and 4) as carton body 12 is moved to the collapsed position. Thus, floor 23 can automatically fold into an orientation that is substantially perpendicular to encircling side wall 14 as carton body 12 is moved from the collapsed configuration to the erected position. One of the benefits of automatic folding floor 23 is that it does not require any addition adhesive, sealing tape or stickers to maintain floor 23 in the erected position shown in FIG. 5 after it is moved to the erected position. However, in other embodiments, floor 23 need not be an automatic folding floor and other conventional floors could be used.

Returning to FIG. 1 and as indicate above, carton body 12 also includes a covering 29. Covering 29 can project and/or extend from upper end 20 of encircling side wall 14 (e.g., adjacent to access opening 22 to compartment 16). In at least one embodiment, covering 29 can comprise a plurality of covering panels extending, respectively, from upper edges 80*a*, 82*a*, 84*a*, and 86*a* of side wall panels 80, 82, 84, and 86. For instance, as depicted in the FIGS. 1 and 2, covering 29 comprises an inner top closure panel 30 that projects or extends from upper edge 86*a* of side wall panel 86. In particular, inner top closure panel 30 has an inside edge 30*c* (connected to upper edge 86*a* of side wall panel 86) and an opposing outside edge 30*a*, each extending between opposing side edges 30*b* and 30*d*. In at least one embodiment, opposing side edges 30*b* and 30*d* can be (substantially) aligned with opposing side edge 86*b* and 86*d*, respectively, of side wall panel 86.

Figure 8:
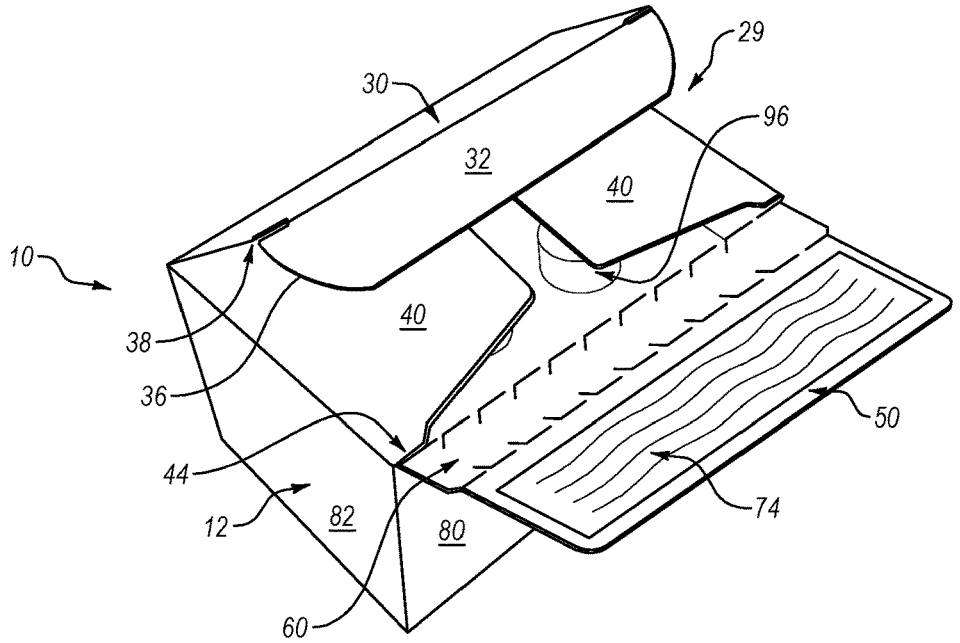
FIG. 8 is a top perspective view of the zipper carton assembly of FIG. 7 in a partially closed configuration.
Figure 9:
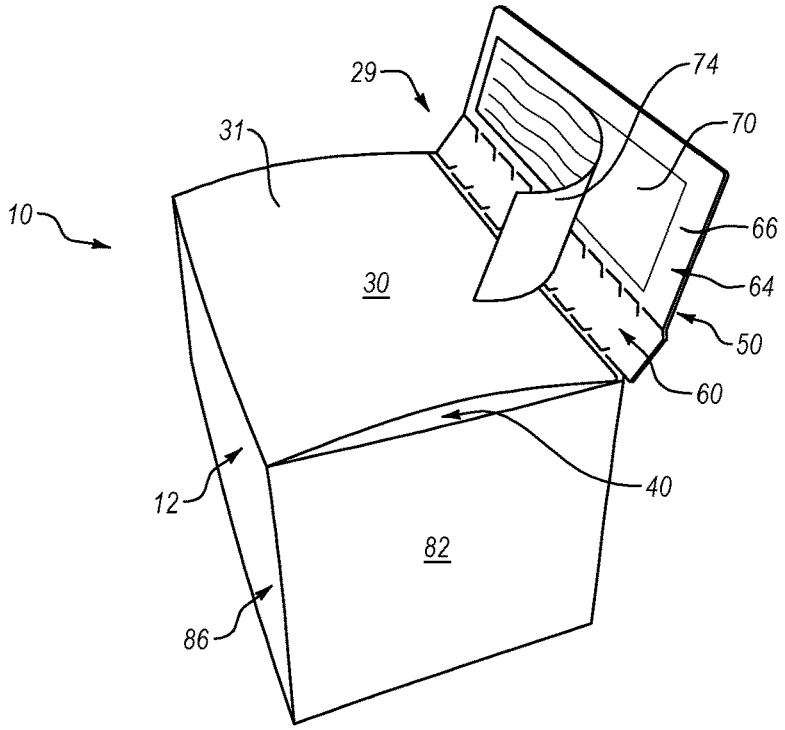
FIG. 9 is a top perspective view of the zipper carton assembly of FIG. 7 in a closed and unsealed configuration.

As illustrated in FIGS. 8 and 9 and discussed in further detail below, inner top closure panel 30 is foldable into a closed position to selectively cover at least a portion of access opening 16. Accordingly, as depicted in FIGS. 1 and 2, a foldable tuck flap 32 can be formed extending from outside edge 30*a* of inner top closure panel 30. Tuck flap 32 can have opposing rounded side edges 36 and slits 38 extending along crease formed therebetween for easy insertion into access opening 22 and/or compartment 16 and/or secure retention therein. Other embodiments can lack slits 38 and/or have side edges 36 that are other than rounded without departing from the scope of this disclosure.

Returning to FIGS. 1 and 2, carton body 12 also includes optional opposing dust flaps 40 projecting from upper end 20 of side wall 14 (e.g., from the respective upper edges 82*a* and 84*a* of side wall panels 82 and 84, respectively). Each dust flap 40 is also selectively foldable into a closed position to cover at least a portion of access opening 22 (see FIG. 8). As depicted in FIG. 2, each dust flap 40 can have a slanted or recessed edge 42 that terminates at a tuck flap engagement tab 44. Tuck flap engagement tabs 44 are configured to capture tuck flap 32 when inner top closure panel 30 and dust flaps 40 are moved into the closed position, thereby holding inner top closure panel 30 in the closed position. In other embodiments, however, edge 42 need not be slanted and/or engagement tabs 44 can be eliminated.

Continuing with FIGS. 1 and 2, carton body 12 also includes an outer top closure panel 50 that projects from upper end 20 of side wall 14 opposite inner top closure panel 30. In particular, outer top closure panel 50 has an inside edge 50*c* (connected to upper edge 80*a* of side wall panel 80) and an opposing outside edge 50*a*, each extending between opposing side edges 50*b* and 50*d*. In at least one embodiment, opposing side edges 50*b* and 50*d* can be (substantially) aligned with opposing side edges 80*b* and 80*d*, respectively, of side wall panel 80. In at least one embodiment, at least a portion of opposing side edges 50*b* and 50*d* can be narrower than opposing side edges 80*b* and 80*d*, respectively, of side wall panel 80.

Figure 11:
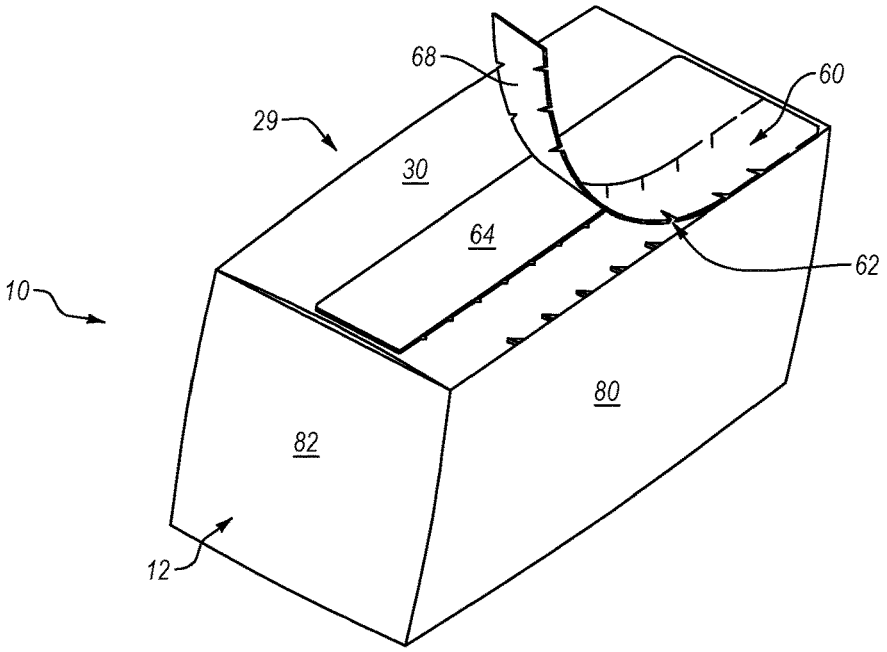
FIG. 11 is a top perspective view of the zipper carton assembly of FIG. 10 in a partially unzipped configuration.

Outer top closure panel 50 comprises an attachment portion 64 and a removable zipper tear strip 60 formed between attachment portion 64 and inside edge 50*c*. Removable zipper tear strip 60 comprises an integral portion of outer top closure panel 50 and is formed by producing two spaced apart rows of perforations 62 that are aligned between and substantially extend between side edges 50*b* and 50*d*. In the embodiment depicted, perforations 62 have a substantially V-shaped configuration with one leg linearly extending along the length of the row and the other leg sloping to the center between the rows. In other embodiments, perforations 62 can have different configurations. Perforations 62 are linearly spaced apart and typically extend completely through outer top closure panel 50. In at least one embodiment, removable zipper tear strip 60 can be disposed at or adjacent to inside edge 50*c* of outer top closure panel 50. By outwardly pulling on one end of zipper tear strip 60, the small sections of outer top closure panel 50 disposed between adjacent perforations 62 are torn through, thereby enabling zipper tear strip 60 to be removed from outer top closure panel 50 as depicted in FIG. 11. The removal of zipper tear strip 60 causes separation and/or disconnection of outer top closure panel 50 (directly) from encircling side wall 14 and, more specifically from front panel 80 thereof.

Attachment portion 64 is disposed on a side of the zipper tear strip 60 remote from inside edge 50*c* of outer top closure panel 50. In at least one embodiment, at least a part of attachment portion 64 can be narrower (e.g., between opposing side edges 50*b* and 50*d*) then side wall panel 80 (e.g., between opposing side edges 80*b* and 80*d*). Attachment portion 64 can have an inner surface 66 that is planar and can extend continuous with inner surface 15 of encircling side wall 14. Accordingly, as depicted in FIG. 2, inner surface 66 of attachment portion 64 and inner surface 15 of side wall 14 can be disposed on the same side of carton body 12.

As further depicted in FIG. 2, adhesive layer 70 of zipper carton assembly 10 can be disposed on inner surface 66 of attachment portion 64/outer top closure panel 50. In at one embodiment, adhesive layer 70 can comprise a layer of glue or adhesive, double sided tape, and/or other sticky- or tacky-type material. For instance, adhesive layer 70 can comprise a synthetic rubber adhesive or rubberized glue adapted for permanent bonding and/or adhesion to plastic, paper, and/or other suitable material. Accordingly, adhesive layer 70 can have a strong initial tack for creating a permanent bond between two portions of carton body 12. Those skilled in the art will appreciate that a "permanent bond" as used herein refers to a secure adhesion of two components intended for permanent association and does not necessarily imply physical inability to separate the two components.

In at least one embodiment, adhesive layer 70 can comprise a double-coated tape. For instance, adhesive layer 70 can comprise a first adhesive layer disposed on a first side or surface of a backing member and a second adhesive layer disposed on an opposing second side or surface of the backing member. The backing member can comprise a polyester film (e.g., polyethylene terephthalate or PET), thermoplastic polymer/resin, or other material suitable for receiving one or more adhesive layers on opposing sides or surfaces thereof. The adhesive disposed on the opposing sides of the backing member can comprise a synthetic rubber. One example of a double-coated tape is the LUDLOW TAPE M-Tak 7420L available from Berry Plastics.

Since the drugs used in blinded trials on occasion need to be shipped cold, it is desirable that the adhesive be operable (i.e., maintain its adhesive properties) at temperatures ranging from at least below −40° C., −60° C. or −80° C., up to at least above 40° C., 60° C., 82° C. or higher, or any range of temperatures therebetween. For instance, certain drugs are typically maintained at about −80° C. during storage and/or use. Other drugs are typically stored, transported, and/or administered at higher temperatures (e.g., in remote villages in high temperature regions of the world). In some embodiments, the adhesive can be selected to be operable in a temperature range suitable for the drug to be disposed therein.

Adhesive layer 70 (or adhesive layers thereof) can have a length extending at least partially between opposing side edges 50*b* and 50*d* and can have a variety of suitable dimensions and or sizes. For instance, adhesive layer 70 can have a thickness (up from inner surface 66 of attachment portion 64) of up to, at least, or about 0.1 mm, 0.2 mm, 0.25 mm, 0.5 mm, 1 mm, 1.5 mm, 2 mm, 2.5 mm, and/or 5 mm or between any of the foregoing. Thicknesses less than 0.1 mm or greater than 5 mm are also contemplated herein. Adhesive layer 70 (or adhesive layers thereof) can also have a width of up to, at least, or about 2 mm, 5 mm, 10 mm and/or 20 mm or between any of the foregoing. Widths less than 2 mm or greater than 20 mm are also contemplated herein.

A removable liner 74 can be disposed over at least a portion of adhesive layer 74. For instance, removable liner 74 can comprise a polymeric sheet or strip covering at least a portion of adhesive layer 70. In at least one embodiment, removable liner 74 completely covers adhesive layer 70 such that adhesive layer 70 is not exposed on inner surface 66 of attachment portion 64 of outer top closure panel 50.

Removable liner 74 can also have at least one lifting edge 68 at an end thereof. In at least one embodiment, lifting edge 68 can be easily accessible to fingertips for griping and removing removable liner 74. Moreover, removable liner 74 can have printing 76 disposed thereon. For instance, printing 76 can comprise writing printed on a surface of removable liner 74 and/or indicating an expiration date for adhesive layer 70.

As previously mentioned, floor 23 need not be an automatic folding floor but could have other configurations. For example, floor 23 could have the same configuration as covering 29 discussed above or could be the same as covering 29 except not include zipper tear strip 60 on outer top closure panel 50. In still other embodiments, floor 23 could comprise dust flaps 40 and inner top closure panel 30 with tuck flap 32. In yet other embodiments, floor 23 can comprise 3 or 4 separate panels that fold over and are held together by an adhesive such as a glue, tape, or sticker.

Methods of Assembling and Using Zipper Carton Assembly

Illustrative methods of using zipper carton assembly 10 will now be described. It will be appreciated, however, that zipper carton assembly 10 can have a variety of alternative uses, which will be apparent to those skilled in the art or through practice of the present disclosure.

Initially, zipper carton assembly 10 is typically manufactured into the flat, collapsed configuration depicted in FIG. 6 at a manufacturing facility. This is typically accomplished by forming template 18 of carton body 12 as depicted in FIG. 2. Template 18 is usually formed by using conventional cutting techniques to cut template 18 from a single, unitary continuous sheet of material, such as those previously discussed. In alternative embodiments, template 18 could comprise two or more separate parts that are connected together such as through adhesive, tape or fasteners. The cutting process includes the formation of zipper tear strip 60. Once template 18 is formed, adhesive layer 70 is secured to attachment portion 64 of outer top closure panel 50. Removable liner 74 is typically previously attached to adhesive layer 70 before securing to outer top closure panel 50, but could be attached after the placement of adhesive layer 70. In another alternative embodiment, it is appreciated that adhesive layer 70 and removable liner 74 can be attached to the sheet of material before template 18 is cut therefrom or could be placed at a stage during the cutting process.

Once template 18 is formed, template 18 is folded and attachment flap 88 is secured to the interior surface of side wall panel 82, thereby forming encircling side wall 14. As depicted in FIG. 3, attachment flap 88 can be secured to the inner surface of side wall panel 82 through the use of an adhesive. Again, to enable cold shipping of the zipper carton assemblies 10, in one embodiment it is desirable that all adhesives used on carton assembles 10 be operable at temperatures at least below −40° C., −60° C. −80° C., up to at least above 40° C., 60° C., 82° C., or higher, or any range of temperatures therebetween. Those skilled in the art will appreciate that attachment flap 88 can alternatively be secured to the outer surface of side wall panel 82. Likewise the process could be reversed by having attachment flap 88 formed on side panel 82 and then attached to rear panel 86.

Floor 23 is assembled as previously discussed. Specifically, floor panel attachment flap 28 of each floor panel 25 is attached to the floor panel 26 (immediately) adjacent to the attachment flap 28 by an adhesive, thereby forming opposing sub-floors. The connected floor panels 25 and 26 are folded into compartment 16 of carton body 12 as depicted in FIGS. 3 and 4. In this assembled configuration, zipper carton assembly 10 can be placed in the flat collapsed configuration depicted in FIG. 6. At this stage, the collapsed zipper carton assemblies 10 are typically stacked and packaged with other collapsed zipper carton assemblies 10 and then shipped to a separate facility where they are manipulated to the erected configuration as depicted in FIGS. 1 and 5 and then loaded with the blinded trial product.

Those skilled in the art will appreciate that zipper carton assembly 10 can be assembled in any suitable order. For instance, opposing sides of encircling side wall 14 can be connected before or after assembly of floor 23 without necessarily departing from the scope of this disclosure. In addition, zipper carton assembly 10 can be at least partially assembled by machine. For instance, foldable sheet 18 can be inserted into a carton assembly machine (not shown) adapted for securing attachment flap 88 to side wall panel 82 and/or assembling floor 23 as described above. Those skilled in the art will also appreciate that other floor configurations are also contemplated herein, including overlapping, stacked floors, unitary floors, and so forth.

Figure 7:
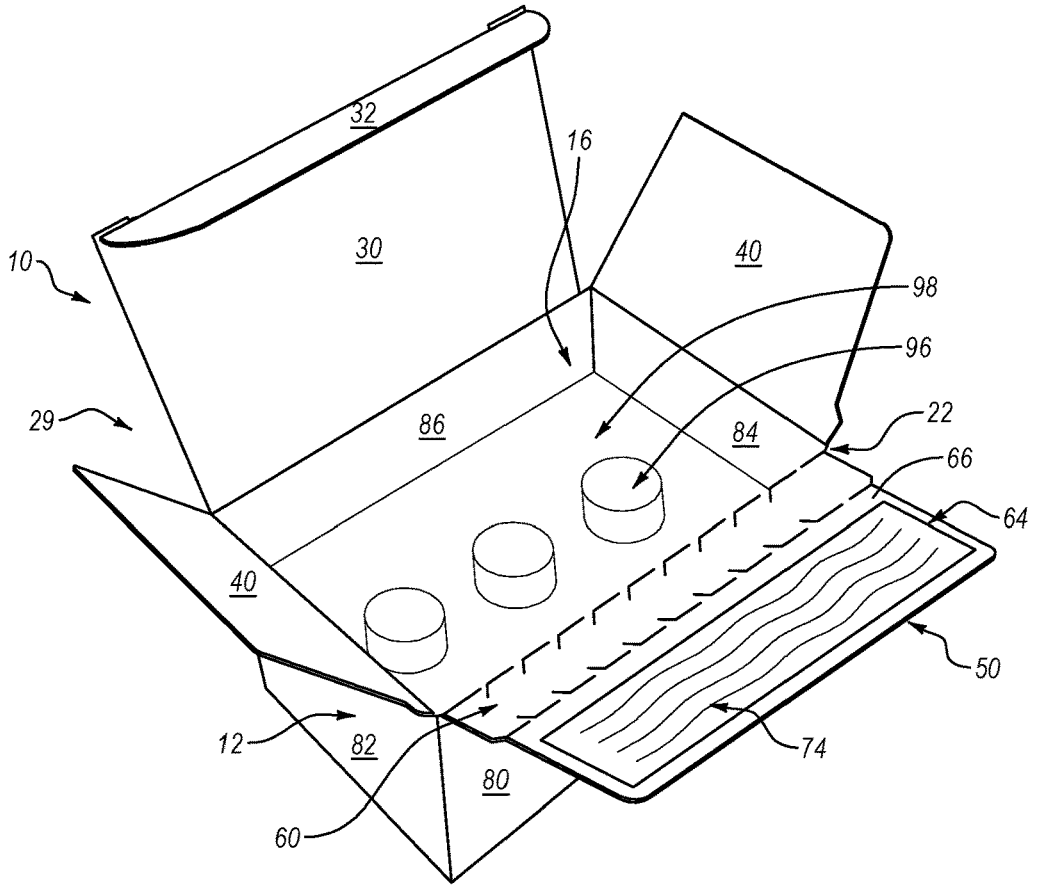
FIG. 7 is a top perspective view of the zipper carton assembly of FIG. 1 having a product disposed therein.

FIGS. 7 through 13 illustrate one method of how collapsed zipper carton assemblies 10 obtained from a manufacture can be used for loading, delivering and dispensing blinded trial products. Once the collapsed zipper carton assemblies 10 are obtained they can be manipulated to the erected position as discussed above and depicted in FIGS. 1 and 5. While in the erected position, a blinded trial product 96 can be placed within inner compartment 16 of zipper carton assembly 10, as illustrated in FIG. 7. In at least one embodiment, blinded trial product 96 can comprise one or more different products (e.g., CTM). For example, blinded trial product 96 can comprise a test product which can comprise an active drug product, a comparative product, a control product, a placebo product, or one or more combinations of the foregoing. Furthermore, in different zipper carton assemblies or in the same zipper carton assembly, the active drug product, comparative product, control product, and/or placebo product can be provided in different quantities, volumes, concentrations, strengths, types (i.e., pill, ointment, liquid, injection, etc.) or combinations of the foregoing. Furthermore, in at least one embodiment, blinded trial product 96 can include multiple dosages or concentrations of one or more different blinded trial products 96. Accordingly, blinded trial product 96 can comprise a plurality of different containers and different container types being placed in the same or different zipper carton assemblies. Depending on the form of the drug being tested, the foregoing products may be housed in pill bottles, syringes, vials, tubes or other conventional containers.

Blinded trial product 96 can also comprise one or more support products such as antiseptics, band aids, swabs, gauze, tape, instructions, disposal containers or any other accessories that may be used or associated with the drug being tested. The bind trial product 96 can be held securely within compartment 16 by way of packaging 98. In some embodiments, "blinded trial products" (or similar terms) can include any clinical trial material (CTM) and does not need to be limited to blinded materials or materials used in blinded trials or studies or components used therein.

Once blinded trial product 96 has been properly packed within zipper carton assembly 10, zipper carton assembly 10 can then be moved from the erected, opened position illustrated in FIG. 7 to an erected, closed position illustrated in FIG. 9. This is accomplished by folding optional dust flaps 40 inward so as to extend over compartment 16 and folding inner top closure panel 30 inward in like manner as depicted in FIG. 8. Tuck flap 32 projecting from inner top closure panel 30 is advanced into compartment 16 so that a portion of side edges 36 of tuck flap 32 adjacent to notch 38 can be inserted beneath tuck flap engagement tab 44 of dust flap 40 and/or between engagement tab 44 and outer top closure panel 50 (or side wall 14). Inner top closure panel 30 can thereby be held tightly against folded dust flaps 40 in the closed position.

As illustrated in FIGS. 9 and 10, erected, closed zipper carton assembly 10 can then be sealed closed by removing (e.g., peeling away) removable liner 74 from adhesive 70 and folding outer top closure panel 50 against inner top closure panel 30 so that adhesive layer 70 bonds inner surface 66 of attachment portion 64 to outer surface 31 of the inner top closure panel 30. In so doing, zipper carton assembly 10/compartment 16 becomes sealed closed so that blinded trial product 96 cannot be accessed or tampered with until zipper carton assembly 10 is opened by the removal of zipper tear strip 60. As illustrated in FIG. 10, removable zipper tear strip 60 is disposed on the upper surface of covering 29 when zipper carton assembly 10 is in the sealed position.

Either prior to, during, or after loading of the blinded trial product 96, one or more labels can be secured on the exterior or interior surface of carton body 12. The labels can provide instructions, identification indicia, or other relevant information for the blinded trial. Once zipper carton assembly 10 is sealed closed, it can be packaged with other zipper carton assemblies 10 for transporting as a group or can be individually transported to a first recipient (e.g., medical practitioner such as an administering technician). The technician can then administer the blinded trial product 96 (e.g., by opening zipper carton assemblies 10, removing blinded trial product 96, and so forth) or deliver the zipper carton assemblies 10 to a second recipient for administration of the blinded trial product 96.

In certain embodiments, filled, closed, and sealed zipper carton assembly 10 (e.g., a blinded kit carton) can be distributed to a hospital or clinic where they can be distributed to patients either directly on site or for the patient to take home for self-administration. It will also be noted that steps of erecting zipper carton assembly 10, inserting blinded trial product 96 therein, closing zipper carton assembly 10, sealing zipper carton assembly 10, and labeling zipper carton assembly 10 can be accomplished by up to five separate people. In at least one embodiment, however, a plurality of said steps is performed by the same person. For instance, in at least one embodiment, each of the foregoing steps is performed by the same person.

Figure 12:
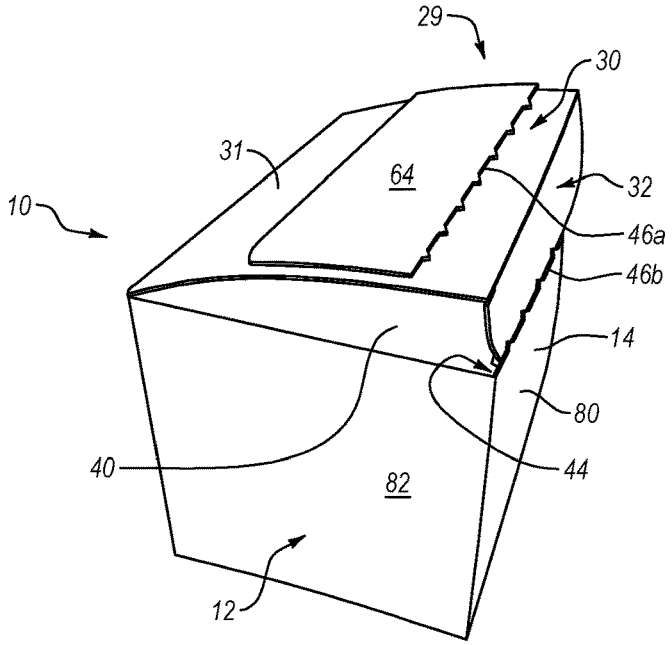
FIG. 12 is a top perspective view of the zipper carton assembly of FIG. 10 in an unzipped and partially opened configuration.

The sealed zipper carton assembly 10 is typically opened by a recipient, such as the administering technician of the medical practice participating in the trial or the patient receiving the dosage thereof. As illustrated in FIGS. 10, 11, and 12, sealed zipper carton assembly 10 can be opened by removing the zipper tear strip 60 from the upper surface of covering 29. For instance, a lifting tab 68 of removable zipper tear strip 60 can be (easily) pulled away from attachment portion 64 of outer top closure panel 50. By pulling on lifting tab 68, zipper tear strip 60 is pulled away from attachment portion through the assistance of perforations 62. Upon complete removal of the zipper tear strip 60, as depicted in FIG. 12, attachment portion 64 is still secured to upper surface 31 of inner top closure panel 30. A jagged edge 46*a* on attachment portion 64 can indicate removal of zipper tear strip 60. Similarly, the upper edge of the front panel 80 from which zipper tear strip 60 was removed can also have a jagged edge 46*b*.

Figure 13:
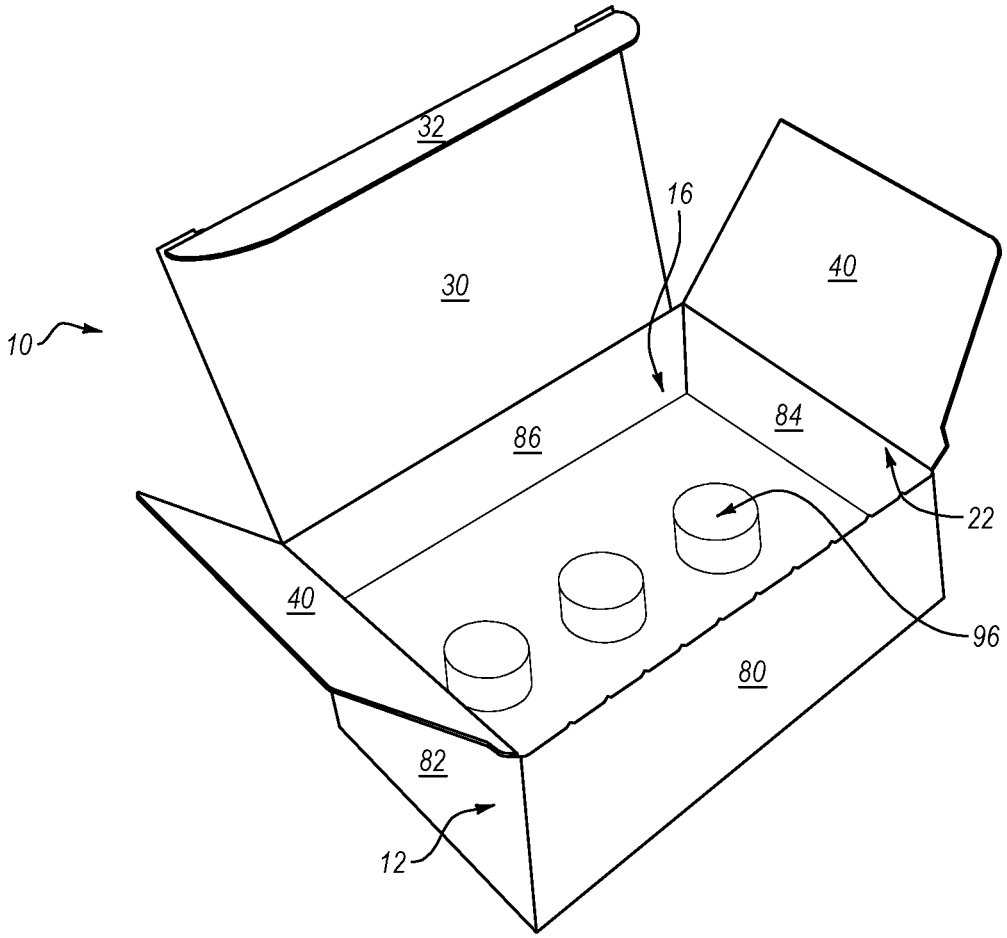
FIG. 13 is a top perspective view of the zipper carton assembly of FIG. 10 in an unzipped and opened configuration.

As illustrated in FIGS. 12 and 13, once zipper tear strip 60 is removed, inner top closure panel 30 can be raised to so as to permit access to blinded trial products 96 within compartment 16. Specifically, tuck flap 32 of inner top closure panel 30 can be removed from its secured position within compartment 16 and then inner top closure panel 30 can be folded back. Optional dust flaps 40 can also be opened to more easily access and remove blinded trial product 96 from compartment 16.

It will be appreciated that zipper carton assembly 10 or carton body 12 thereof can be reclosed by reversing the foregoing steps involving dust flaps 40, inner top closure panel 30, and tuck flap 32. However, because zipper tear strip 60 has been removed such that attachment portion 64 remains secured to upper surface 31 of inner top closure panel 30, zipper carton assembly 10 or carton body 12 thereof cannot be resealed as before. Alternative resealing mechanisms can be employed to re-secure zipper carton assembly 10 or carton body 12 thereof. For instance, a sealing sticker can be attached to inner top closure panel 30 and to encircling side wall 14 in some embodiments.

Figure 14:
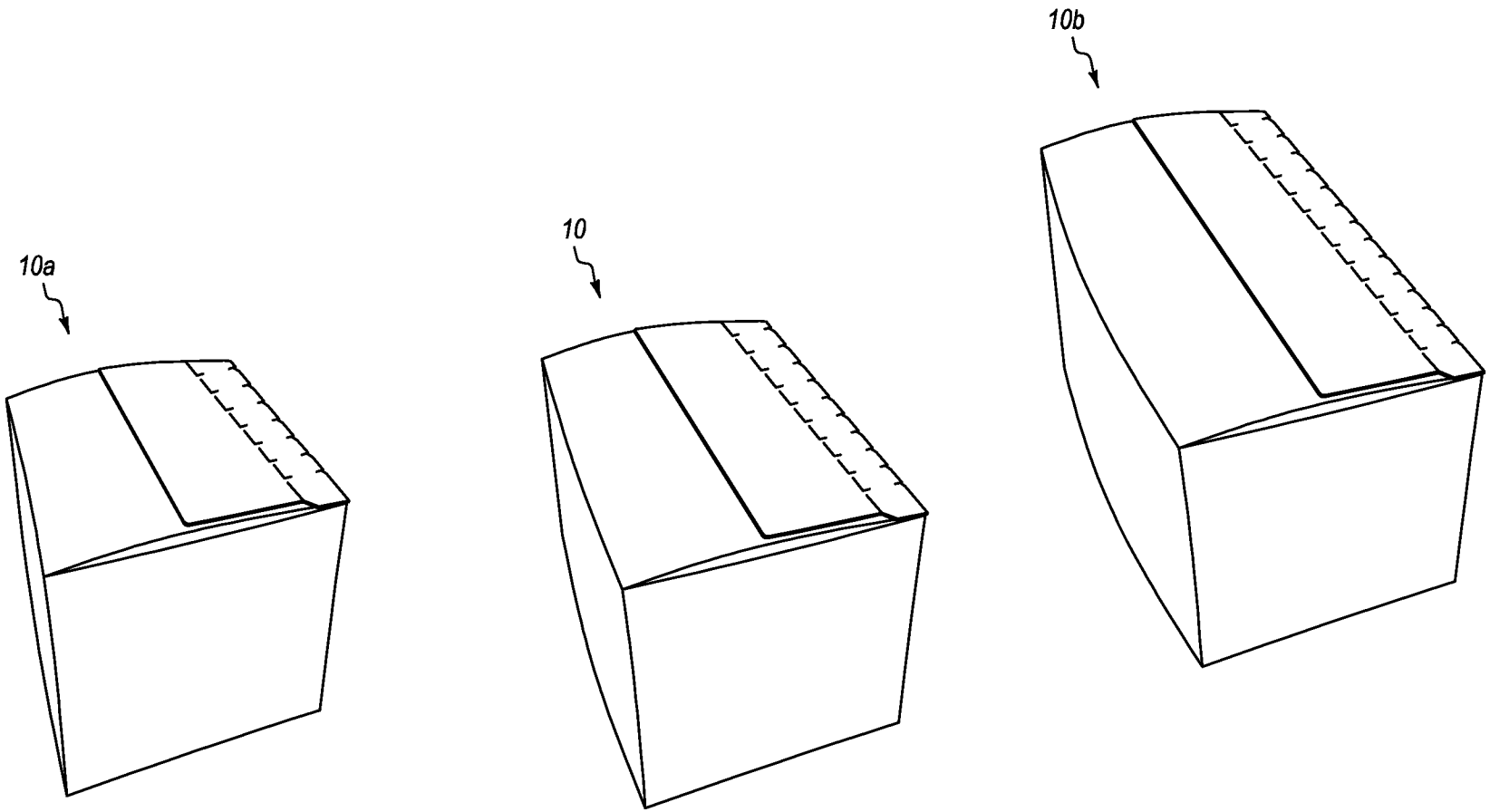
FIG. 14 is a top perspective view of zipper carton assemblies of varying sizes according to embodiments of the present disclosure.

FIG. 14 depicts a variety of exemplary zipper carton assemblies of different sizes, each of which may be suitable for certain embodiments of the present disclosure. For instance, in addition to zipper carton assembly 10 (having a rectangular cross-section as described above), FIG. 14 also depicts a zipper carton assembly 10*a* (having a substantially square-shaped cross-section) and a zipper carton assembly 10*b* (having an elongated rectangular cross-section). Those skilled in the art will appreciate that zipper carton assemblies 10*a* and 10*b* can be configured substantially similar to zipper carton assembly 10 and that zipper carton assemblies 10, 10*a*, and 10*b* (and/or respective compartments 16 thereof) can each have a different (interior) volume and/or different (outer and/or inner) dimensions. In other embodiments, it is appreciated that zipper carton assemblies can have other configurations and sizes.

Figure 15:
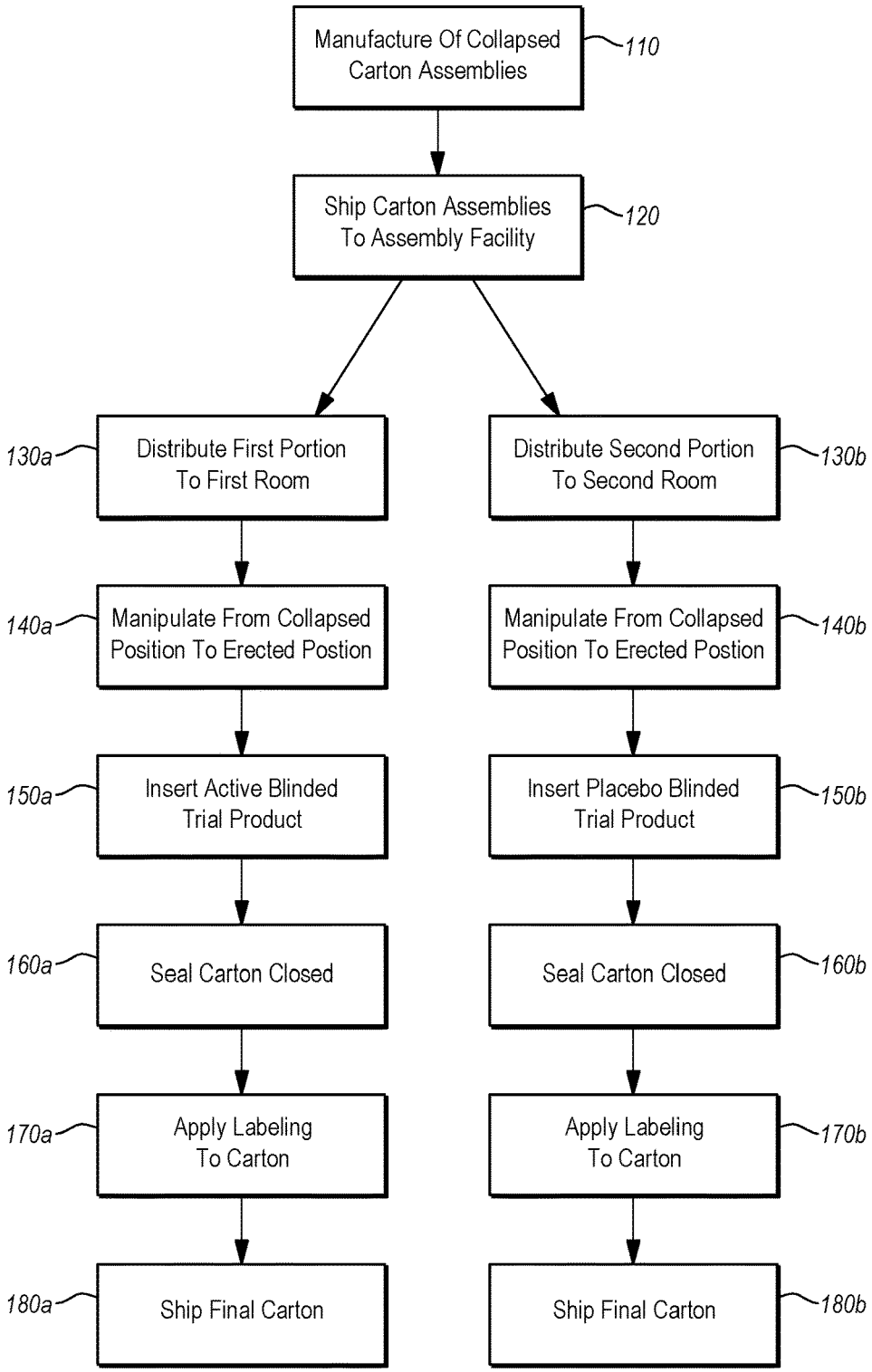
FIG. 15 is a flowchart illustrating a method of using the zipper carton assemblies according to an embodiment of the present disclosure.

FIG. 15 shows a flowchart depicting one method of conducting a blinded trial according to certain embodiments of the present disclosure. The method can include a step 110 of manufacturing a plurality of zipper carton assemblies at a manufacturing facility, as described above, and a step 120 of transporting (e.g., shipping, carrying, etc.) a plurality of the zipper carton assemblies to a separate blinded trial kit assembly facility. In at least one embodiment, the manufactured and/or transported zipper carton assemblies can be disposed in the collapsed configuration described above and illustrated by FIG. 6 for ease in shipping and/or handling.

The plurality of collapsed zipper carton assemblies can then be divided such that a first portion of the plurality of zipper carton assemblies is distributed to a first room of the assembly facility (step 130*a*) and a second portion of the plurality of zipper carton assemblies is distributed to a second room of the assembly facility (step 130*b*) that is separate from the first room. In some embodiments, the method and/or blinded trial protocol may require separate rooms (e.g., separated by a wall, divider, or other means for separation) for assembling blinded trial kits with different blinded trial products disposed therein. For instance, in at least one embodiment, the blinded trial protocol requires, calls for, and/or outlines that an active drug product be isolated in a first room of a kit assembly facility, while a control, compare, and/or placebo product be isolated in a second room of a kit assembly facility away and/or remote from the first room. Such separation may ensure the integrity, fidelity, and/or accuracy of the blinded trial by maintaining separate kit assembly rooms to guard against product confusion and/or mix-up. In other embodiments, it is appreciated that three, four, or more separate rooms can be used for packaging different active drug products, comparative products, control products, placebo products, combinations of the foregoing or different doses or concentrations of the foregoing. That is, a separate room can be used for packaging each different test product or blinded trial product being packaged.

The method may also include steps 140*a* and 140*b* of manipulating the first portion and the second portion of the plurality of zipper carton assemblies (e.g., in the first kit assembly room and the second kit assembly room, respectively) from the collapsed position into the erected position as described above. In the first kit assembly room, a first active drug product is then inserted into the inner compartment of one or more of the first portion of the plurality of zipper carton assemblies (step 150*a*). Likewise, in the second kit assembly room, a placebo product is inserted into the inner compartment of one or more of the second portion of the plurality of zipper carton assemblies (step 150*b*). In either room, as desired, a control or compare product can also be packaged with the active drug product or the placebo product. Indeed, a variety of combinations are available for grouping CTM according to various protocols. Those skilled in the art will appreciate that instructions can also be included in the sealed zipper carton assemblies to ensure proper conducting of the clinical trial or other form of product administration. The instructions can comprise the protocol parameters, including dosage amounts, times, and frequencies, as well as which product to administer in the given dosage amounts, times, and frequencies.

Zipper carton assemblies having a blinded test product disposed therein can then be sealed closed (steps 160*a* and 160*b*) as described above (by removing the removable adhesive liner from the adhesive layer disposed on the inner surface of the outer top closure panel and folding the outer top closure panel (and/or attachment portion thereof) against the outer surface of the inner top closure panel such that the inner surface of the attachment portion becomes (permanently) bonded to a portion of the outer surface of the inner top closure panel). The method can then include steps 170*a* and 170*b* of applying a label and/or labeling to each of the sealed zipper carton assemblies (e.g., in the first and second rooms, respectively). The sealed and labeled (final) cartons (i.e., blinded trial kits) can then be transported (e.g., shipped, carried, etc.) from the respective first and second rooms to a third room in the kit assembly facility and/or from the kit assembly facility to a remote location for delivery to an administering technician or recipient.

It will be appreciated that steps taking place in the first room and second room, respectively, need not occur simultaneous. In addition, in at least one embodiment, the second room can be in second facility. Accordingly, where controlled separation of the two portions of the plurality of zipper carton assemblies is desired, a variety of suitable separation strategies can be employed in various embodiments of the present disclosure. Embodiments of the present disclosure can also be implemented in a variety of alternative methods without departing from the scope of this disclosure.

It is appreciated that the inventive zipper carton assemblies and related methods of assembly and use have unique advantages over the prior art. For example, in one embodiment of the present invention the zipper carton assembly is sealed closed by removing removable liner 74 from adhesive layer 70 and then pressing outer top closure panel 50 against inner top closure panel 30 so as to adhere the two together. This assembly thus eliminates the need for any separate sealing sticker to seal the carton closed. Eliminating the sealing stickers eliminates the risk that different cartons could have stickers placed differently which could lead the recipient to infer that the blinded trial products within the cartons are different, and thereby partially defeat the purpose of blinded trial. In contrast, because the outer top closure panel 50 for each carton assembly is identical and because they fully cover the adhesive layer 70 when moved to the closed position, all sealed zipper carton assemblies are identical in appearance with regard to the mechanism for sealing and thus there is no chance to infer differences between blinded trial products within the container. Furthermore, because of the integrated adhesive layer and the elimination of sealing stickers, it is simpler to seal the cartons closed and easier to provide instruction to those who are loading and sealing the cartons.

In addition, because of the use of the zipper tear strip to unseal the containers, the containers are easier to open and there is less risk of unintentional opening or rupturing during transport.

Furthermore, by using an automatic folding floor on the cartons, no separate adhesive or sealing sticker is required to be mounted on the floor when in the erected position which could likewise function to differentiate between different cartons. Other advantages also exist.

Alternative Zipper Carton Assembly

Figure 16:
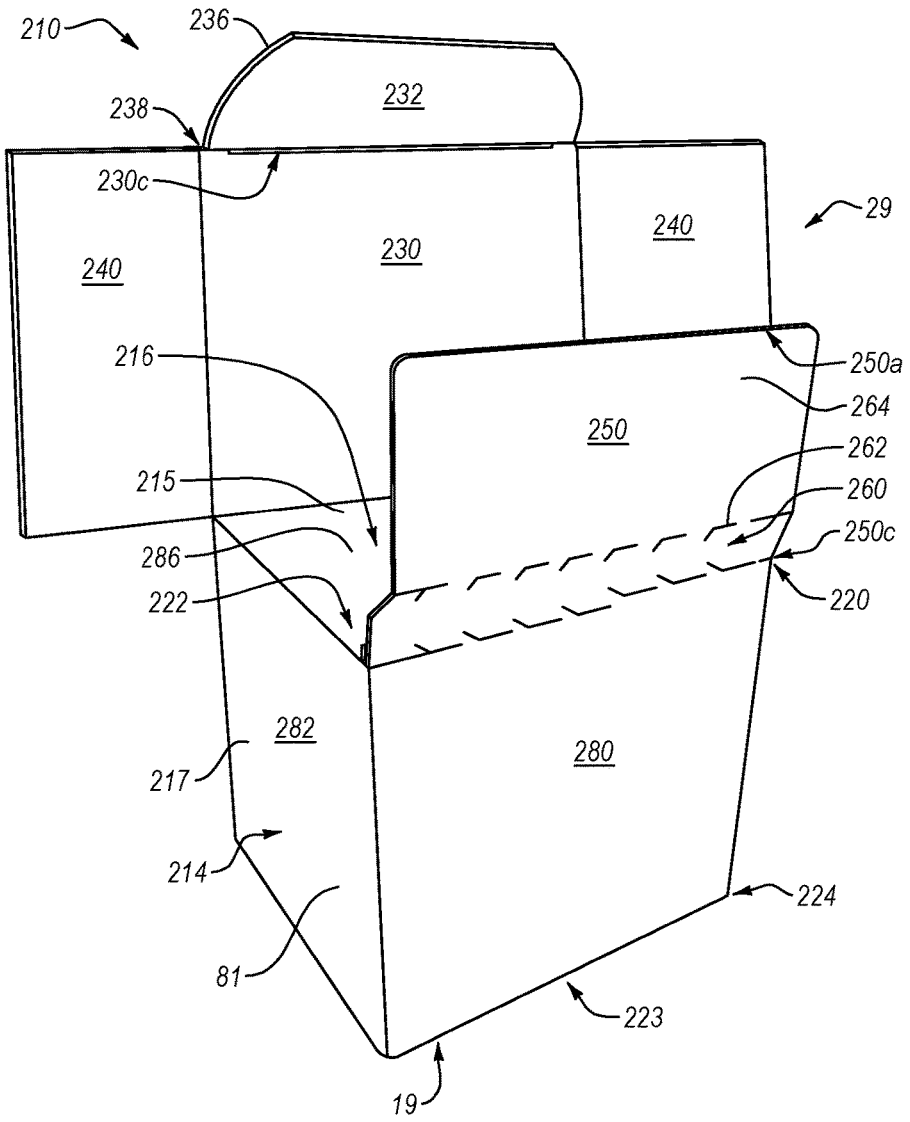
FIG. 16 is a front perspective view of another embodiment of a zipper carton assembly in an erected and opened configuration incorporating features of the present disclosure.
Figure 17:
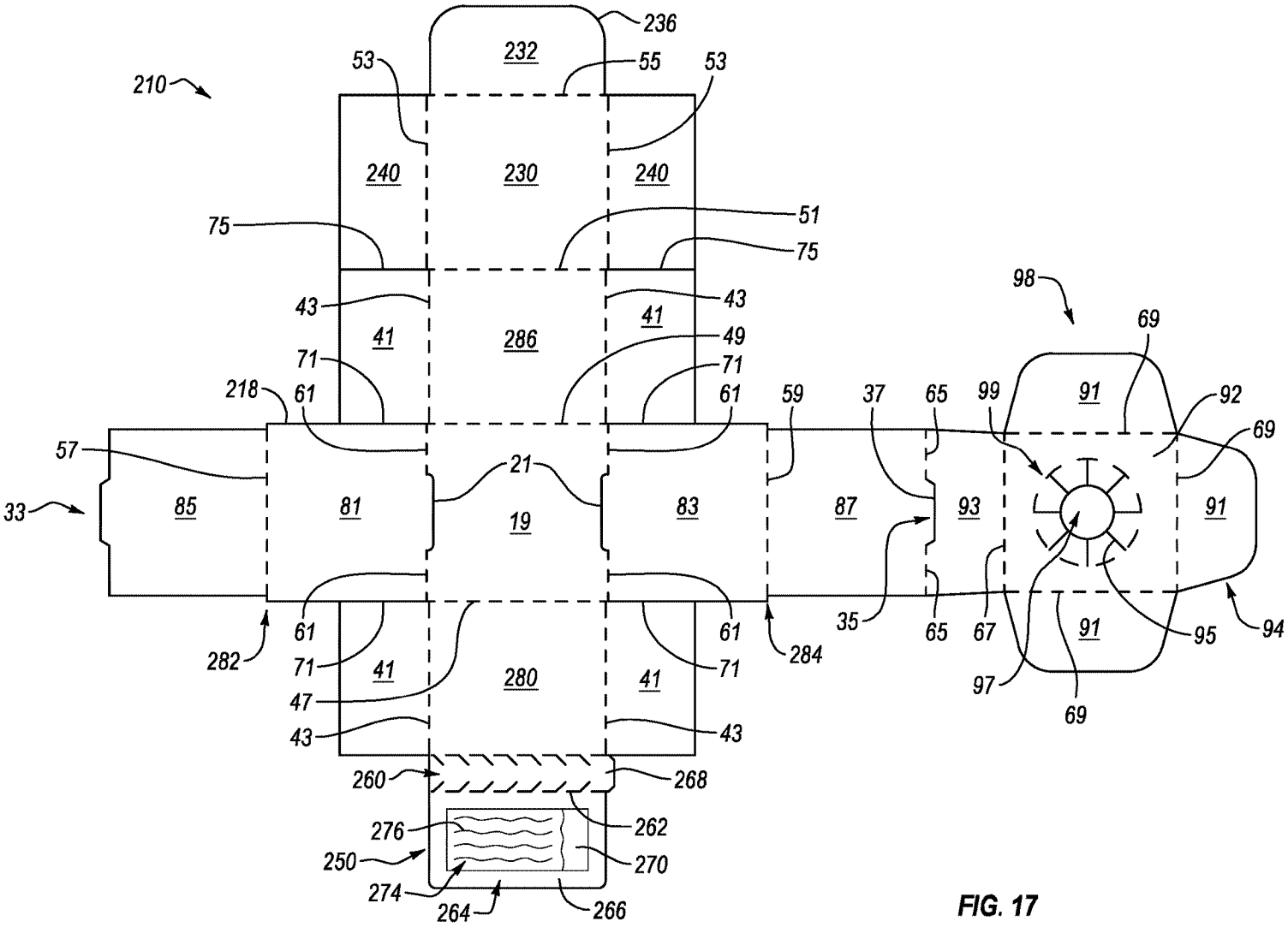
FIG. 17 is a top plan view of the zipper carton assembly shown in FIG. 16 in a flat, un-erected configuration.

Depicted in FIGS. 16 and 17 is an alternative embodiment of a zipper carton assembly 210 incorporating features of the present disclosure. Zipper carton assembly 210 can generally comprise components similar to those described in relation to zipper carton assembly 10 and like number references (preceded by a number 2) have been used to indicate like structure or structure that performs like function(s). However, zipper carton assembly 210 has various features that are different than those illustrated in zipper carton assembly 10. For instance, unlike zipper carton assembly 10, zipper carton assembly 210 has an encircling side wall 214 and a floor 223 that are formed from a different arrangement of panels. In particular, as illustrated in FIG. 17, floor 223 can comprise a single floor panel 19 disposed and connected between a front panel 280 and a rear panel 286, with a first crease 47 disposed between floor panel 19 and front panel 280, and a second crease 49 disposed between floor panel 19 and rear panel 286.

Floor panel 19 is also disposed and connected between opposing side panels 282 and 284. However, unlike side panels 82 and 84 of zipper carton assembly 10, side panels 282 and 284 each comprise an outer panel 81, 83 and an inner panel 85, 87 connected at upper end 220 of encircling side wall 214, with a crease 57, 59 disposed therebetween. Each inner panel 85, 87 includes a tab 33, 35 aligned with and/or insertable into a floor panel slit 21 disposed in floor panel 19 adjacent to creases 61. In some embodiments, crease 61 can comprise two creases 61 disposed on opposite sides of a slit 21.

Front panel 280 and rear panel 286 each have opposing flaps 41 extending laterally therefrom in opposite directions, with a crease 43 disposed between panel 280, 286 and flap 41. In the erected configuration illustrated in FIG. 16, flaps 41 are each disposed within folded side panels 282, 284 (i.e., between outer side panel 81, 83 and an inner panel 85, 87). A cut 71 separates and/or disconnects each flap 41 from an adjacent outer side panel 81, 83.

Returning to FIG. 17, similar to zipper carton assembly 10, an inner top closure panel 230 can extend from an upper edge of rear panel 286, with a crease 51 disposed therebetween. Unlike zipper carton assembly 10, however, dust flaps 240 extend laterally (outward) from inner top closure panel 230, in opposite directions, with a crease 53 disposed therebetween. Dust flaps 240 can extend laterally (outward) from inner top closure panel 230 a distance less than, similar to, equal to, or greater than adjacent flaps 41 extend from rear panel 286. A cut 75 separates and/or disconnects each dust flap 240 from adjacent flaps 41. Those skilled in the art will appreciate that inner top closure panel 30 of zipper carton assembly 10 (see FIGS. 1 and 2) can be arranged similar to inner top closure panel 230 in certain embodiments. Inner top closure panel 230 also has a tuck flap 232 extending therefrom with a crease 55 disposed therebetween. In at least one embodiment, however, unlike tuck flap 32 of zipper carton assembly 10 (see FIGS. 1 and 2), tuck flap 232 does not include slits (e.g., slits 38) extending along crease 55 for easy insertion into access opening 222 and/or compartment 216. It will be appreciated, however, that tuck flap 232 can include one or more slits in other embodiments.

An outer top closure panel 250 extends from the upper edge of front panel 280 and includes a zipper tear strip 260, an adhesive strip 270, and a removable liner 274.

Zipper carton assembly 210 also includes a packaging 98 incorporated into template 218. In particular, packaging 98 is connected to and/or extends from a bottom end of inner side panel 87, with a crease 65 disposed therebetween. In some embodiments, and as illustrated in FIG. 17, crease 65 comprises two creases 65 disposed on opposite sides of a slit 37 that forms tab 35. Packaging 98 includes a first support flap 93 connected to inner side panel 87 adjacent to crease 65 and/or slit 37. Thus, crease 65 and/or slit 37 can be disposed between first support flap 93 and inner side panel 87. Packaging 98 also includes a packaging panel 92 connected to first support flap 93 opposite inner side panel 87 with a crease 67 disposed between packaging panel 92 and first support flap 93.

Packaging panel 98 has a product receiving element 99 formed therein. Product receiving element 99 can have a variety of suitable configurations. For instance, product receiving element 99 can comprises a partially collapsible socket or opening 67 formed by a plurality of slits 95 disposed in packaging panel 92. It will be appreciated, however, that a variety of alternative product retaining mechanisms known to those skilled in the art are also contemplated herein. In addition, packaging 98 and/or packaging panel 92 thereof can include a plurality of product receiving elements 99 in certain embodiments.

As further depicted in FIG. 17, packaging 98 further comprises three additional support flaps 91 connected to packaging panel 92 adjacent and/or opposite first support flap 93, each with a crease 69 disposed between packaging panel 92 and the respective support flap 91. Support flap 91 can have a rounded outer edge 94 in some embodiments to allow for easy insertion into access opening 222 and/or compartment 216. Alternative embodiments can include one, two, four, or more additional support flaps 91.

It will be appreciated, therefore, that zipper carton assembly 210 can have one or more unique benefits and/or features. For instance, unlike zipper carton assembly 10, zipper carton assembly 210 does not necessarily require an adhesive material in order to manufacture, assemble, erect, form, manipulate, etc. zipper carton assembly 210 and/or zipper carton assembly template 218 into the zipper carton assembly 210. Instead, zipper carton assembly 210 can be self-supporting in a manufactured, assembled, erected, formed, manipulated, etc. configuration. It will be appreciated that zipper carton assembly 210 can still include an adhesive layer for sealing the zipper carton assembly upon being assembled, erected, formed, manipulated, etc. without negating the above-recited benefit and/or otherwise departing from the present disclosure.

Alternative Method of Assembling and Using Zipper Carton Assembly

Figure 18:
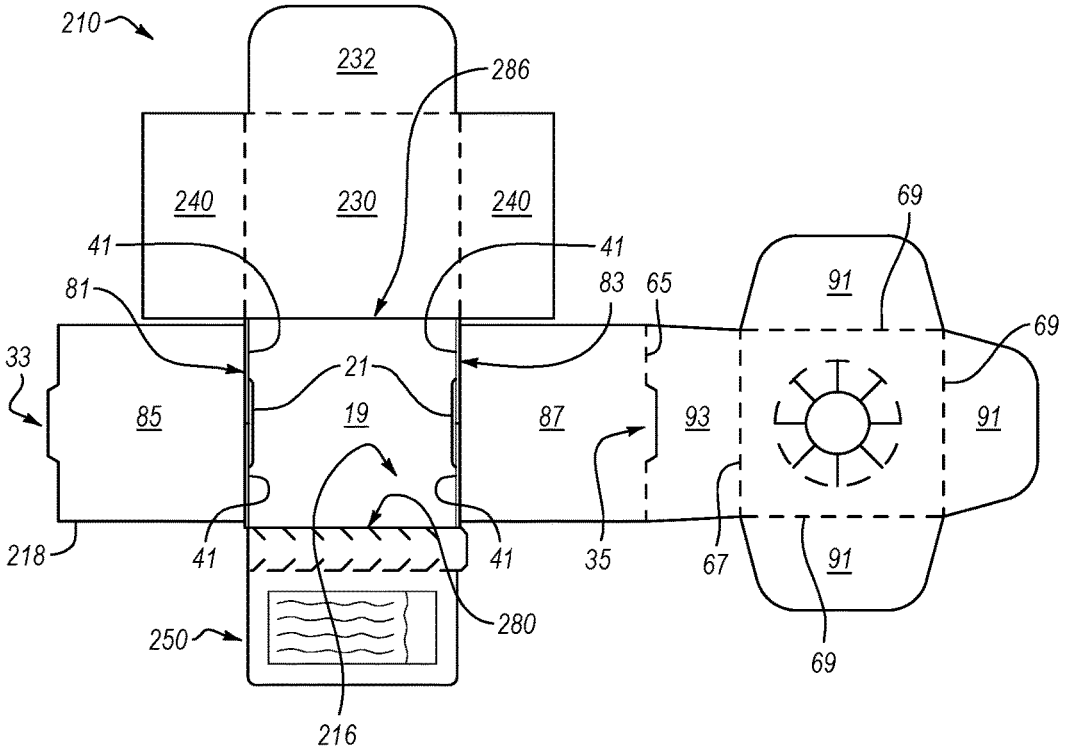
FIG. 18 is a top plan view of the zipper carton assembly of FIG. 16 in a partially erected configuration.
Figure 19:
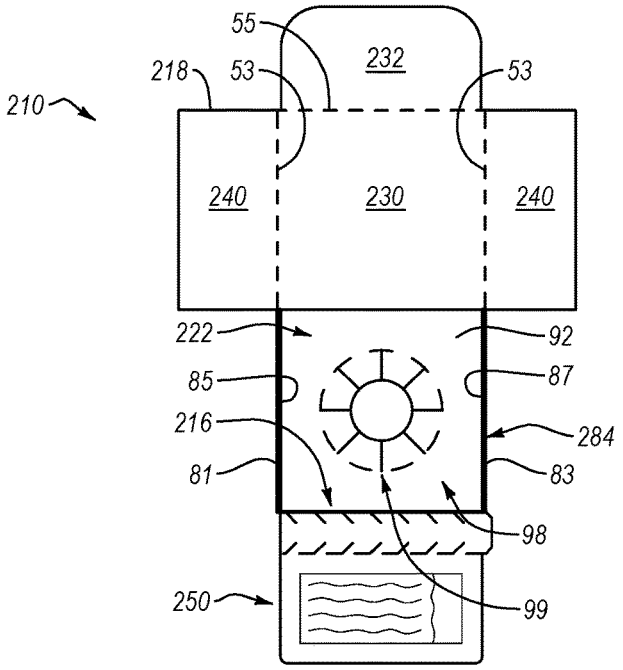
FIG. 19 is a top plan view of the zipper carton assembly of FIG. 16 in another erected and opened configuration.
Figure 20:
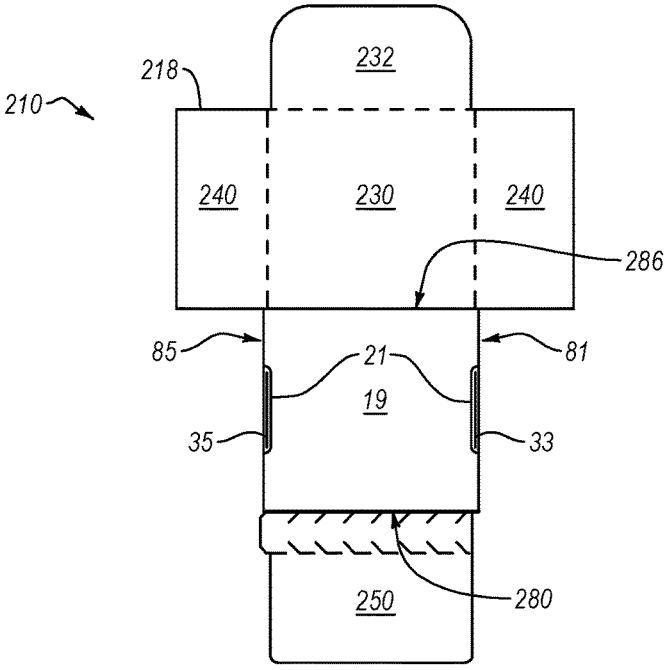
FIG. 20 is bottom plan view of the zipper carton assembly of FIG. 19.
Figure 21:
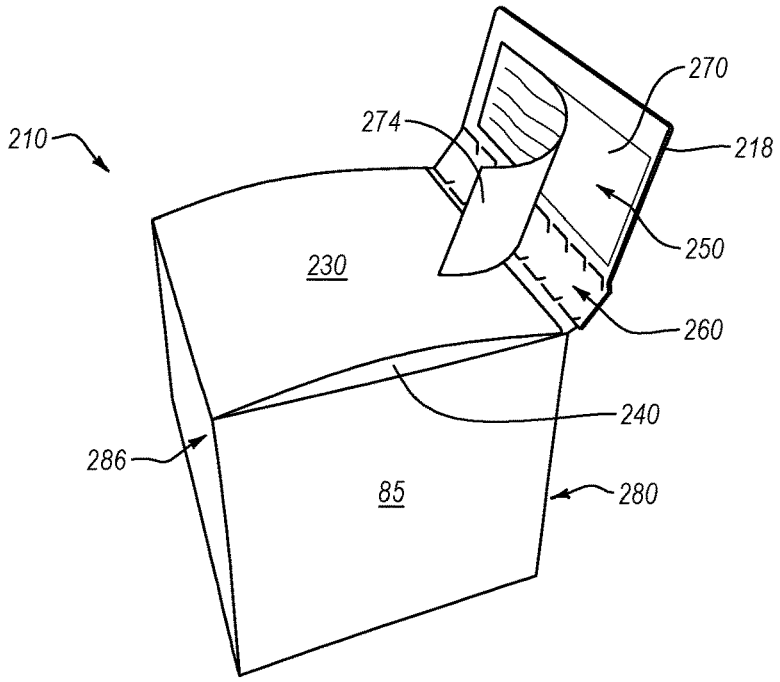
FIG. 21 is a top perspective view of the zipper carton assembly of FIG. 16 in a closed and unsealed configuration.
Figure 22:
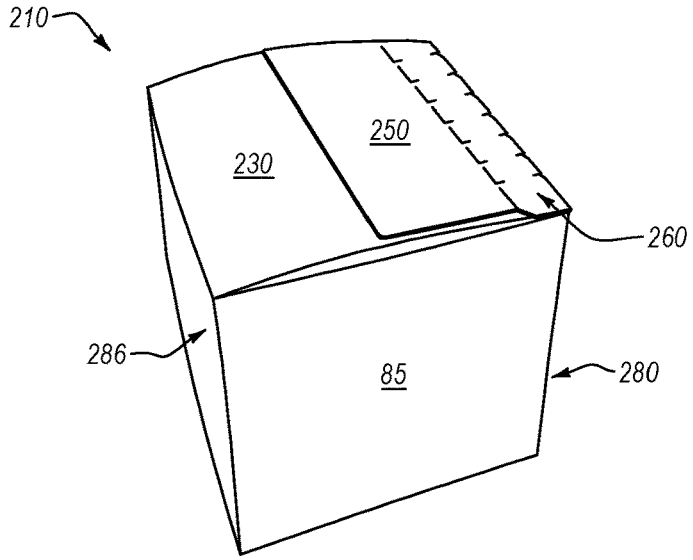
FIG. 22 is a top perspective view of the zipper carton assembly of FIG. 16 in a closed and sealed configuration.

FIGS. 18 through 22 illustrate an exemplary method of erecting, assembling, and/or using zipper carton assembly 210. Zipper carton assembly 210 can be manipulated from a flat, non-erected position, as shown in FIG. 17, to an erected position where encircling sidewall 214 has a rectangular transverse configuration as shown in FIGS. 21 and 22. For instance, as illustrated in FIG. 18, with floor panel 19 forming a bottom, the sheet material of template 218 is folded at creases 47 and 49 such that front panel 280 and rear panel 286 are folded upward in a motion that begins to form compartment 216. The sheet material of template 218 is also folded at creases 43 such that each pair of opposing flaps 41 are folded inward toward compartment 216. The sheet material of template 218 is also folded at creases 61 such that outer side panels 81 and 83 are folded upward toward compartment 216 and/or against folded flaps 41.

As illustrated in FIG. 19, the sheet material of template 218 is then folded at crease 57 such that inner side panel 85 is folded downward, into compartment 216 and/or against folded flaps 41, forming a completed and/or erected first side wall 282. Accordingly, folded flaps 41 are disposed and/or sandwiched between outer side panels 81 and inner side panel 85 during assembly of zipper carton assembly 210. Side wall tab 33 is also inserted into first floor panel slit 21 disposed at the interface between floor panel 19 and outer side panel 81, thereby reversibly securing inner side panel 85 in a folded configuration that maintains first side panel 282 in an erected configuration.

The sheet material of template 218 is also folded at crease 59 such that inner side panel 87 is folded downward, into compartment 216 and/or against folded flaps 41, forming a completed and/or erected second side wall 284 in similar fashion. Side wall tab 35 is also inserted into second floor panel slit 21 disposed at the interface between floor panel 19 and outer side panel 83, thereby reversibly securing inner side panel 87 in a folded configuration that maintains second side panel 284 in an erected configuration. As depicted in FIG. 20, tabs 33 and 35 can protrude out of the bottom of zipper carton assembly 210, floor 223, and/or floor panel 19 thereof in the erected, reversibly secure configuration.

Returning to FIG. 19, the sheet material of template 218 is also folded at creases 65, 67, and 69 such that packaging 98 is properly erected and inserted into compartment 216, with support flaps 91, 93 extending upward from floor panel 19 such that packaging panel 92 is raised off of floor panel 19. Specifically, the sheet material of template 218 is folded at crease 65 such that first support flap 93 folds upward substantially against inner side panel 87. The sheet material of template 218 is also folded at crease 67 such that packaging panel 92 folds downward into compartment 216. Additional support flaps 91 are also folded into compartment 216 by folding the sheet material of template 218 at creases 69.

At least one blinded trial product 96 (see e.g., FIG. 7) can also be placed within inner compartment 216 of zipper carton assembly 210. For instance, while in the erected and opened configuration depicted in FIG. 19, blinded trial product 96 can be received by product receiving element 99. Zipper carton assembly 210 can then be closed, sealed, un-sealed, and/or re-opened in a manner similar to zipper carton assembly 10 (see FIGS. 8 through 13) with variations as needed to accommodate the features of zipper carton assembly 210. In particular, as illustrated in FIG. 21, the sheet material of template 218 is folded at crease 51 such that inner top closure panel is folded so as to cover access opening 222, at creases 53 such that dust flaps 240 are disposed and/or inserted into compartment 216, and at crease 55 such that tuck flap 232 is disposed and/or inserted into compartment 216. So configured and/or folded, access opening 222 is substantially covered and/or concealed from view from one or more (e.g., every) vantage point.

Figure 23:
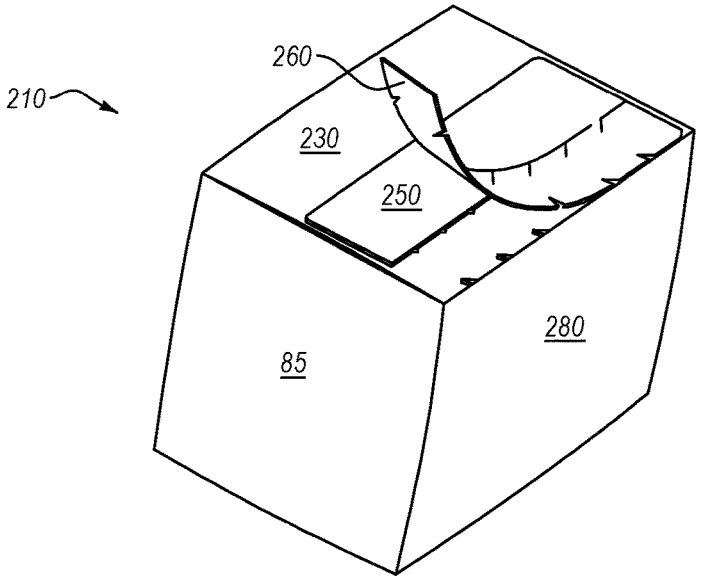
FIG. 23 is a top perspective view of the zipper carton assembly of FIG. 16 in a sealed and partially unzipped configuration.

Removable liner 274 can then be removed (e.g., peeled away), thereby exposing adhesive layer 270. As depicted in FIG. 22, after removing removable liner 274, the sheet material of template 218 is folded at zipper tear strip 260, adjacent to front panel 280, such that outer top closure panel 250 is folded over inner top closure panel 230 and secured thereto by means of (uncovered) adhesive layer 270. As further depicted in FIG. 23, sealed zipper carton assembly 210 can be opened by pulling on lifting edge 268, for example, and removing zipper tear strip 260, as described previously in relation to zipper tear strip 60 (see FIGS. 11-13).

Figure 24:
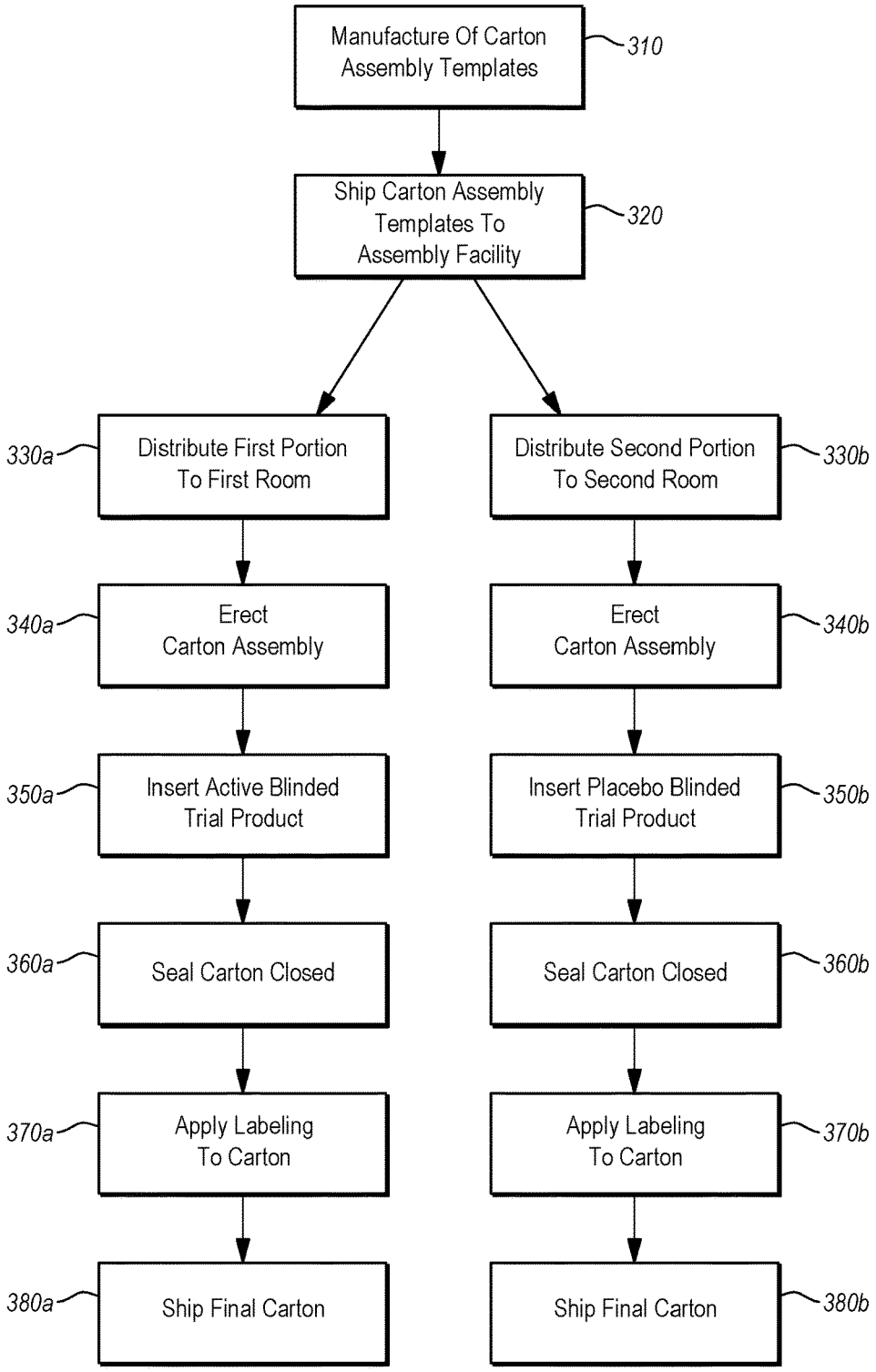
FIG. 24 is a flowchart illustrating a method of using the zipper carton assemblies according to another embodiment of the present disclosure.

FIG. 24 shows a flowchart depicting one method of conducting a blinded trial according to certain embodiments of the present disclosure. The method can include steps similar to the steps outlined in FIG. 15, but with variations as needed to accommodate the alternative embodiment. For instance, a step 310 includes manufacturing of carton assembly templates and step 320 includes shipping the manufactured templates to an assembly facility. At step 330*a*, 330*b*, first and second portions are again distributed into separate rooms. The carton assembly is erected at steps 340*a*, 340*b* within the separate rooms. It will be appreciated, however, that carton assemblies can be erected prior to being distributed into separate rooms in certain embodiments. The remainder of the method can then be performed as previously described.

Some embodiments described here include products and methods related to comparing an active drug to a placebo in a blinded trial study. It will be appreciated that other applicable products and methods of use are also contemplated herein. For instance, certain embodiments can relate to comparing a first dosage amount or concentration of an active drug to a second dosage amount or concentration of the same active drug, and optionally, to a third dosage amount or concentration of the same active drug, and so forth. Accordingly, zipper carton assemblies can each receive one or more dosages or concentrations of a single active drug in certain embodiments.

In addition, some embodiments can relate to comparing a first drug to a second drug. For instance, one or more dosages or concentrations of a first drug can be compared to one or more dosages or concentrations of a second drug. Accordingly, zipper carton assemblies can each receive one or more dosages or concentrations of a plurality drugs (e.g., respectively) in certain embodiments. In at least one embodiment, the second drug can comprise a product already cleared for commercial distribution (e.g., FDA approved).

The foregoing comparisons can each optionally include at least one placebo in certain embodiments (e.g., in blinded (clinical) trial). Embodiments of the present disclosure can also be used in a variety of non-blinded trial-related processes. Indeed, embodiments of the present disclosure can be used as sealable, zipper cartons for any suitable use without necessarily departing from the scope of this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A zipper carton assembly, comprising:

a carton body comprised of a foldable sheet and including:

an encircling side wall that partially bounds a compartment, the encircling side wall having an upper end that bounds an access opening to the compartment and an opposing lower end;

a floor disposed at the lower end of the encircling side wall;

an inner top closure panel projecting from the upper end of the encircling side wall, the inner top closure panel being foldable into a closed position to selectively cover at least a portion of the access opening; and an outer top closure panel having an inner edge and an opposing outer edge that both extend between opposing side edges, the inner edge being connected to the upper end of the encircling side wall so that the outer top closure panel can fold over onto a portion of the inner top closure panel when the inner top closure panel is in the closed position, the outer top closure panel comprising:

a removable zipper tear strip formed by two spaced apart rows of perforations that pass through the outer top closure panel and that are aligned between the opposing side edges; and an attachment portion disposed on a side of the zipper tear strip remote from the inner edge;

an adhesive layer disposed on an inner surface of the attachment portion of the outer top closure panel; and a removable liner covering at least a portion of the adhesive layer;

wherein the encircling side wall comprises a front panel and an opposing rear panel that both extend between opposing first and second side panels, the encircling side wall having a rectangular transverse cross section; and the floor comprises a floor panel having a front edge and an opposing rear edge that both extend between opposing first and second side edges, the front edge being connected to the front panel, the opposing rear edge being connected to the opposing rear panel, the first side edge being connected to the first side panel, and the second side edge being connected to the second side panel.

2. The carton assembly of claim 1, wherein the removable liner comprises a polymeric sheet.

3. The carton assembly of claim 1, wherein the removable liner completely covers the adhesive layer.

4. The carton assembly of claim 1, further comprising:

a pair of opposing dust flaps projecting from the upper end of encircling side wall, the dust flaps being selectively foldable into a closed position to cover at least a portion of the access opening.

5. The carton assembly of claim 1, wherein the entire carton body is formed from the foldable sheet, the foldable sheet being a single, unitary structure of a paper material.

6. The carton assembly of claim 1, wherein the carton body is selectively movable between a non-erected position wherein the carton body is substantially flat and an erected position wherein the encircling side wall has the rectangular transverse cross section.

7. A blinded trial kit comprising:

the zipper carton assembly as recited in claim 1; and a blinded trial product disposed within the compartment of the carton assembly.

8. The blinded trial kit of claim 7, wherein the blinded trial product comprises active drugs or placebos.

9. The carton assembly of claim 1, further comprising a foldable tuck flap extending from an outer edge of the inner top closure panel.

10. The carton assembly of claim 1, further comprising a pair of opposing dust flaps projecting from opposing sides of the inner top closure panel, the dust flaps being selectively foldable such that when the inner top closure panel is in the closed position, the dust flaps are selectively insertable into the compartment.

11. The carton assembly of claim 10, wherein the dust flaps are adapted to cover at least a portion of any gap between the inner top closure panel and the upper end of the encircling side wall when the inner top closure panel is in the closed position.

12. The carton assembly of claim 1, further comprising
- the floor panel further having at least one floor panel slit disposed adjacent to one or more of the first side edge and the second side edge,
- the first and second side panels each comprising an inner side panel and an outer side panel connected at the upper end of the encircling side wall, at least one of the inner side panels comprising a side panel tab insertable into the at least one floor panel slit.

13. The carton assembly of claim 12, further comprising:
- the carton body further comprising packaging disposed in the compartment, the packaging comprising:
  - a first support flap connected to one of the inner side panels at the lower end of the encircling side wall; and
  - a packaging panel connected to the first support flap opposite the inner side panel connected thereto, the packaging panel having at least one product receiving element.

14. The carton assembly of claim 13, wherein the at least one product receiving element comprises a partially collapsible socket formed by a plurality of slits disposed in the packaging panel.

15. The carton assembly of claim 13, wherein the packaging further comprises at least a second support flap connected to the packaging panel adjacent or opposite the first support flap.

16. A method of assembling a blinded trial kit comprising:
- inserting a blinded trial product into the compartment of the carton assembly recited in claim 1;
- folding the inner top closure panel so that it extends over the access opening;
- removing the removable liner from the adhesive layer; and
- folding the outer top closure panel against the inner top closure panel such that the adhesive layer binds the outer top closure panel to the inner top closure panel, thereby sealing the blinded trial product within the compartment of the carton assembly.

17. The method of claim 16, wherein the steps of inserting and folding are accomplished by the same person.

18. The method of claim 16, wherein the steps of inserting and folding are accomplished within the same room at a facility.

19. The method of claim 16, wherein the blinded trial product comprises active drugs or placebos.

20. The method of claim 16, wherein the blinded trial product comprises active drugs or comparators.

21. The method of claim 16, further comprising removing the zipper tear strip from the carton body so as to provide access to the blinded trial product, the attachment portion of the outer top closure panel remaining secured to the inner top closure panel by the adhesive layer.

22. The method of claim 16, further comprising inserting a foldable tuck flap extending from an outer edge of the inner top closure panel into the compartment of the carton assembly.

23. A method of assembling a blinded trial kits comprising:
- (a) obtaining a plurality of the carton assemblies that are movable between a flat, non-erected position to an erected position, each of the plurality of carton assemblies comprising:
  - a carton body comprised of a foldable sheet that when the carton assemblies are in the erected position includes:
    - an encircling side wall that partially bounds a compartment, the encircling side wall having an upper end that bounds an access opening to the compartment and an opposing lower end;
    - a floor disposed at the lower end of the encircling side wall;
    - an inner top closure panel projecting from the upper end of the encircling side wall, the inner top closure panel being foldable into a closed position to selectively cover at least a portion of the access opening; and
    - an outer top closure panel having an inner edge and an opposing outer edge that both extend between opposing side edges, the inner edge being connected to the upper end of the encircling side wall so that the outer top closure panel can fold over onto a portion of the inner top closure panel when the inner top closure panel is in the closed position, the outer top closure panel comprising:
      - a removable zipper tear strip formed by two spaced apart rows of perforations that pass through the outer top closure panel and that are aligned between the opposing side edges; and
      - an attachment portion disposed on a side of the zipper tear strip remote from the inner edge;
  - an adhesive layer disposed on an inner surface of the attachment portion of the outer top closure panel; and
  - a removable liner covering at least a portion of the adhesive layer;
- (b) distributing a first portion of the plurality of the carton assemblies in the non-erected position to a first room, within the first room:
  - manipulating one of the first portion of the plurality of the carton assemblies so that the carton body is moved from the non-erected position to the erected position;
  - inserting a blinded trial product comprising an active drug into the compartment of the carton assembly;
  - folding the inner top closure panel so that it extends over the access opening;
  - removing the removable liner from the adhesive layer; and
  - folding the outer top closure panel against the inner top closure panel such that the adhesive layer binds the outer top closure panel to the inner top closure panel, thereby sealing the blinded trial product within the compartment of the carton assembly, thereby producing a first blinded trial kit; and (c) distributing a second portion of the plurality of the carton assemblies in the non-erected position to a second room that is isolated from the first room, within the second room:

manipulating one of the second portion of the plurality of the carton assemblies so that the carton body is moved from the non-erected position to the erected position;

inserting a blinded trial product comprising one or more placebos having a form complementary to the plurality of medicated dosages into the compartment of the carton assembly;

folding the inner top closure panel so that it extends over the access opening;

removing the removable liner from the adhesive layer; and folding the outer top closure panel against the inner top closure panel such that the adhesive layer binds the outer top closure panel to the inner top closure panel, thereby sealing the blinded trial product within the compartment of the carton assembly, thereby producing a first blinded trial kit.

24. The method of claim 23, wherein the steps performed within the first room further comprise inserting a foldable tuck flap extending from an outer edge of the inner top closure panel into the compartment of the carton assembly.

25. The method of claim 23, further comprising transferring the first blinded trial kit and the second blinded trial kit away from the facility for subsequent use of the blinded trial products.

26. A method of assembling a blinded trial kits comprising:

(a) obtaining a plurality of the carton assemblies that are movable between a flat, non-erected position to an erected position, each of the plurality of carton assemblies comprising:

a carton body comprised of a foldable sheet that when the carton assemblies are in the erected position includes:

an encircling side wall that partially bounds a compartment, the encircling side wall having an upper end that bounds an access opening to the compartment and an opposing lower end;

a floor disposed at the lower end of the encircling side wall;

an inner top closure panel projecting from the upper end of the encircling side wall, the inner top closure panel being foldable into a closed position to selectively cover at least a portion of the access opening; and an outer top closure panel having an inner edge and an opposing outer edge that both extend between opposing side edges, the inner edge being connected to the upper end of the encircling side wall so that the outer top closure panel can fold over onto a portion of the inner top closure panel when the inner top closure panel is in the closed position, the outer top closure panel comprising:

a removable zipper tear strip formed by two spaced apart rows of perforations that pass through the outer top closure panel and that are aligned between the opposing side edges; and an attachment portion disposed on a side of the zipper tear strip remote from the inner edge;

an adhesive layer disposed on an inner surface of the attachment portion of the outer top closure panel; and a removable liner covering at least a portion of the adhesive layer;

(b) moving each of the plurality of the carton assemblies from the non-erected position to the erected position;

(c) distributing a first portion of the plurality of the carton assemblies in the erected position to a first room, within the first room:

inserting a blinded trial product comprising an active drug into the compartment of the carton assembly;

folding the inner top closure panel so that it extends over the access opening;

removing the removable liner from the adhesive layer; and folding the outer top closure panel against the inner top closure panel such that the adhesive layer binds the outer top closure panel to the inner top closure panel, thereby sealing the blinded trial product within the compartment of the carton assembly, thereby producing a first blinded trial kit; and (d) distributing a second portion of the plurality of the carton assemblies in the erected position to a second room that is isolated from the first room, within the second room:

inserting a blinded trial product comprising one or more placebos having a form complementary to the plurality of medicated dosages into the compartment of the carton assembly;

folding the inner top closure panel so that it extends over the access opening;

removing the removable liner from the adhesive layer; and folding the outer top closure panel against the inner top closure panel such that the adhesive layer binds the outer top closure panel to the inner top closure panel, thereby sealing the blinded trial product within the compartment of the carton assembly, thereby producing a first blinded trial kit.

* * * * *